US005540515A

United States Patent [19]

Röck et al.

[11] Patent Number: 5,540,515

[45] Date of Patent: Jul. 30, 1996

[54] APPARATUS FOR SECURING THE FRONT PANEL OF A DRAWER

[75] Inventors: Erich Röck; Klaus Brüstle, both of Höchst; Fredi Dubach, Adetswil, all of Austria

[73] Assignee: Julius Blum Gesellschaft m.b.H., Höchst, Austria

[21] Appl. No.: 280,674

[22] Filed: Jul. 27, 1994

[30] Foreign Application Priority Data

| | | | |
|---|---|---|---|
| Jul. 28, 1993 | [AT] | Austria | 1499/93 |
| Jul. 28, 1993 | [AT] | Austria | 1500/93 |
| Sep. 21, 1993 | [AT] | Austria | 1900/93 |

[51] Int. Cl.[6] ..... F16B 12/20; F16B 12/32

[52] U.S. Cl. ..... 403/407.1; 292/341.17; 403/327; 403/322; 403/405.1

[58] Field of Search ..... 403/405.1, 406.1, 403/407.1, 322, 325, 327; 312/330.1; 292/153, 341.17, DIG. 49

[56] References Cited

U.S. PATENT DOCUMENTS

| | | | |
|---|---|---|---|
| 3,207,565 | 9/1965 | Scharge . | |
| 4,060,949 | 12/1977 | Busse | 403/407.1 X |
| 4,655,489 | 4/1987 | Bisbing | 292/DIG. 49 |
| 4,687,237 | 8/1987 | Bisbing | 292/DIG. 49 |
| 4,752,150 | 6/1988 | Salice | 403/407.1 X |
| 4,826,345 | 5/1989 | Salice | 403/407.1 X |
| 4,846,538 | 7/1989 | Röck et al. | 312/263 |
| 4,850,659 | 7/1989 | Röck et al. | 312/263 |

FOREIGN PATENT DOCUMENTS

| | | |
|---|---|---|
| 0451113 | 10/1991 | European Pat. Off. . |
| 2711036 | 9/1978 | Germany . |

*Primary Examiner*—Anthony Knight
*Attorney, Agent, or Firm*—Wenderoth, Lind & Ponack

[57] ABSTRACT

An apparatus for securing a front panel of a drawer to a drawer frame includes a holding part to be secured to the front panel and a support part to be secured to a drawer frame, one such assembly being provided for each side of the drawer. The holding part can be coupled to the support part, and a spring, preferably a helical spring, acts in the longitudinal direction of the drawer frame between the support part and the holding part. When the front panel is mounted, a limited relative movement of the holding part with respect to the support part in opposition to the spring action is possible.

40 Claims, 24 Drawing Sheets

17
8
1
33
6
9
3
7
40
20
16
19

33
7
40
34
35
35
37
37
19
36
15

6
7'
29
7
33
16
27
40
34
36
9
22
3
39
8
38
32
19
15
37

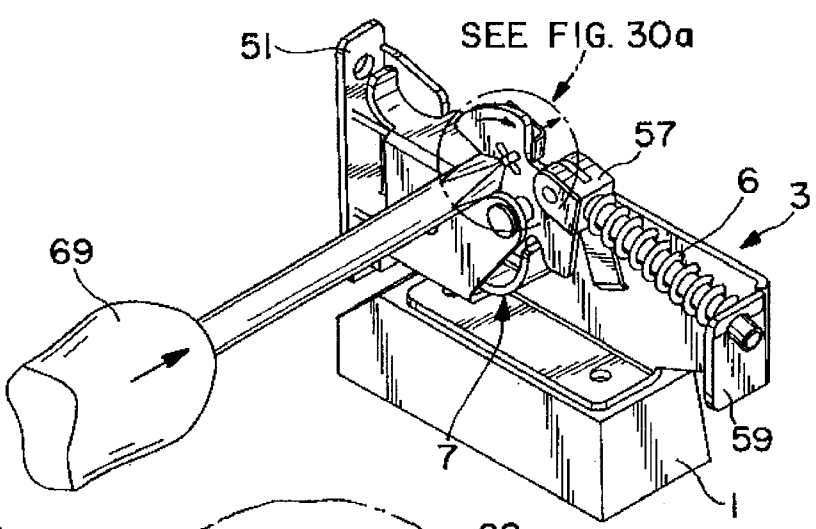
FIG. 30
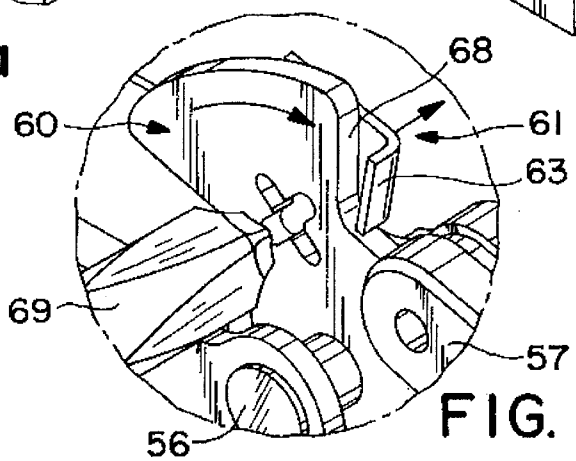
FIG. 30a
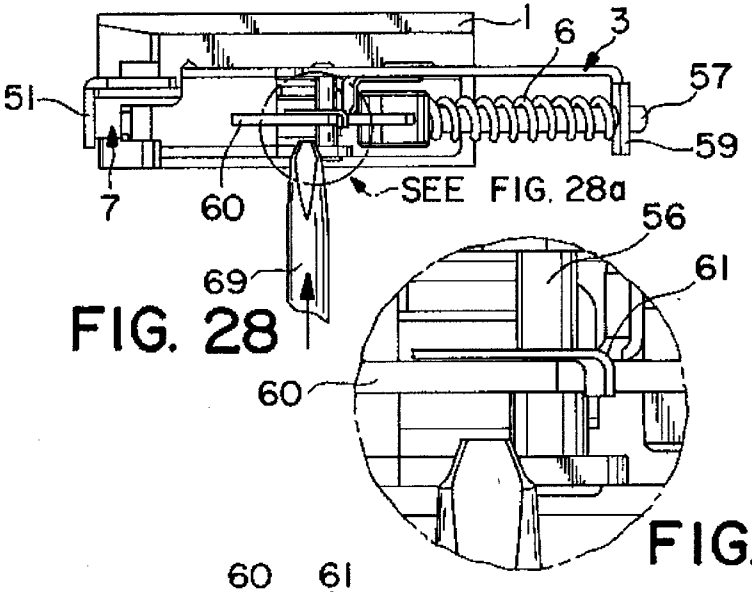
FIG. 28
FIG. 28a
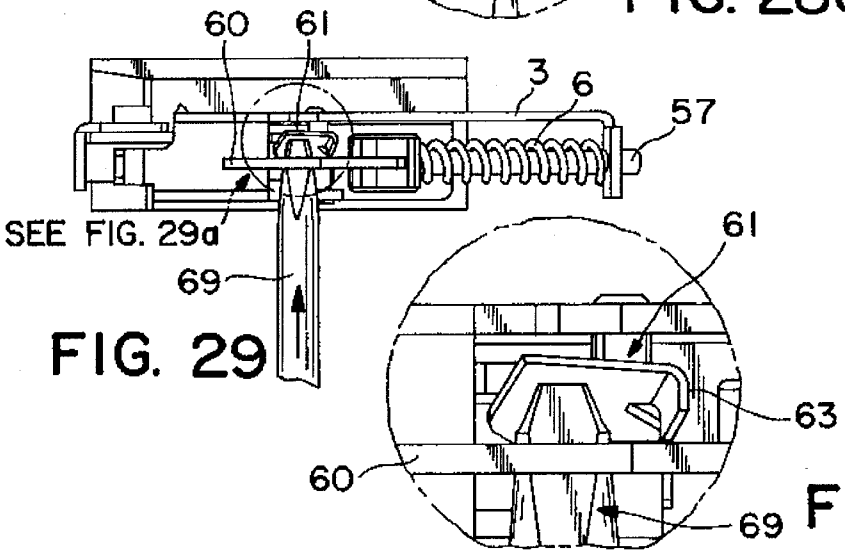
FIG. 29
FIG. 29a

APPARATUS FOR SECURING THE FRONT PANEL OF A DRAWER

BACKGROUND OF THE INVENTION

The invention relates to an apparatus for securing a front panel of a drawer to a drawer frame or side wall and including a holding part secured to the front panel and a support part secured to the drawer frame, one such apparatus being at each side of the drawer, it being possible to couple the holding part to the support part with a spring. An apparatus of this type is known for example from EU-Bl 0 267 477.

SUMMARY OF THE INVENTION

It is the object of the invention to provide an improved apparatus of such type having resilience for the front panel when the drawer is pushed into the furniture carcass too vigorously. In this way, not only are rough jolts avoided, but holding of dowels which are used to anchor the holding parts in the front panel also is improved.

Such object according to the invention is achieved in that the spring, preferably a helical spring, is effective in the longitudinal direction of the drawer frame between the support part and the holding part, and in that when the front panel is mounted a limited relative movement of the holding part with respect to the support part in opposition to the spring action is possible.

BRIEF DESCRIPTION OF THE DRAWINGS

Various embodiments of the invention will be described below with reference to the attached drawings, wherein:

FIG. 28 is a plan view of the apparatus with the holding part suspended in the support part;

FIG. 28*a* is an enlarged view of a detail of FIG. 28;

FIG. 29 is a similar plan view during release of a locking bar;

FIG. 29*a* is an enlarged view of a detail of FIG. 29;

FIG. 30 is a perspective view illustrating turning of a tilt lever to release the holding part from the support part;

FIG. 30*a* is an enlarged view of a detail of FIG. 30;

DETAILED DESCRIPTION OF THE INVENTION

Figures 1, 1A:
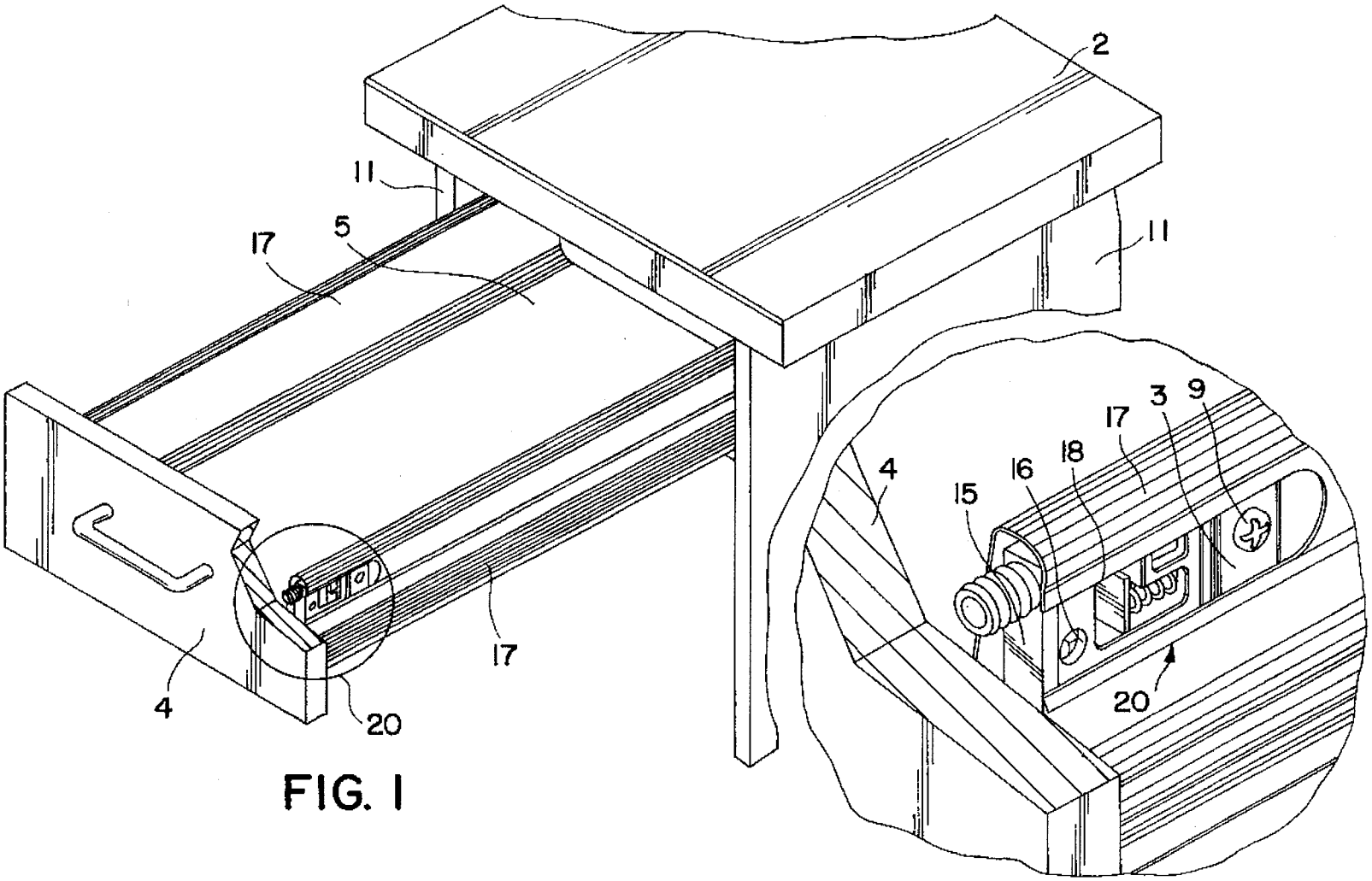
FIG. 1 is a diagrammatic perspective view of a furniture carcass with a drawer, a front panel thereof in the region of a drawer frame being shown cut away.
FIG. 1*a* is an exploded perspective view of a detail of FIG. 1.
Figure 2:
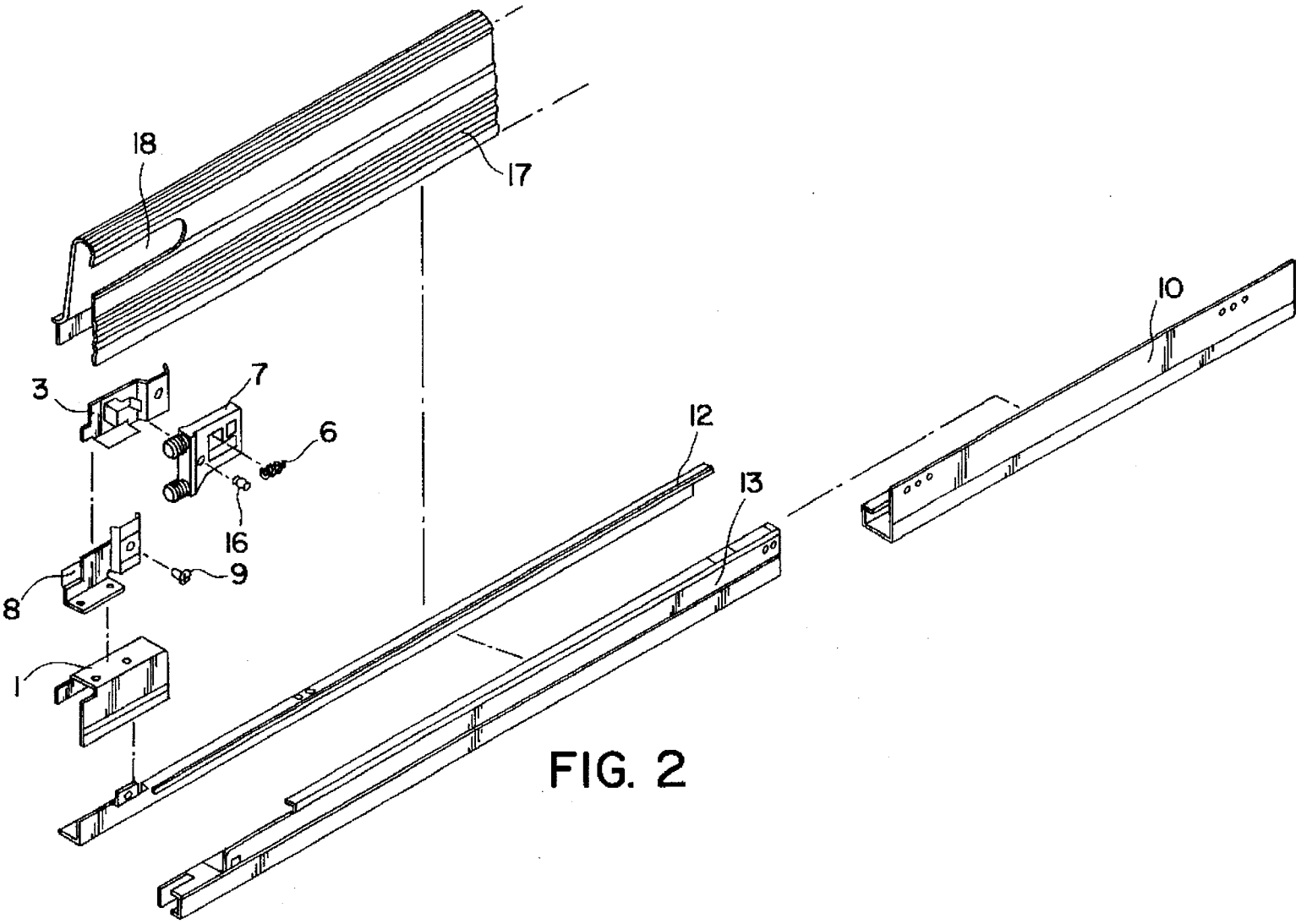
FIG. 2 is an exploded perspective view of the drawer frame, an apparatus for securing the front panel and rails of a pull-out guide fitting.
Figure 3:
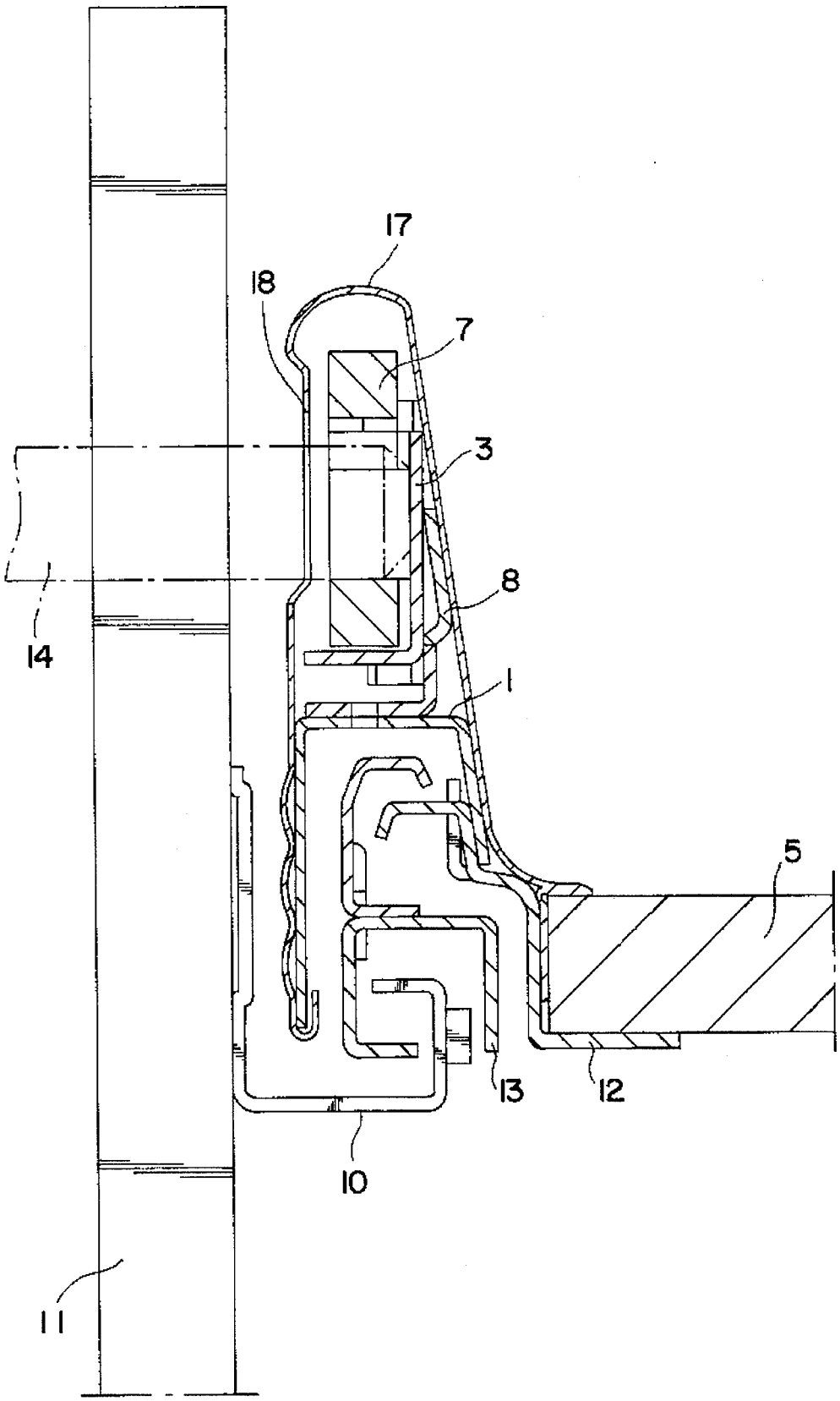
FIG. 3 is a cross-section through the drawer frame and through the rails of the guide fitting.
Figure 5:
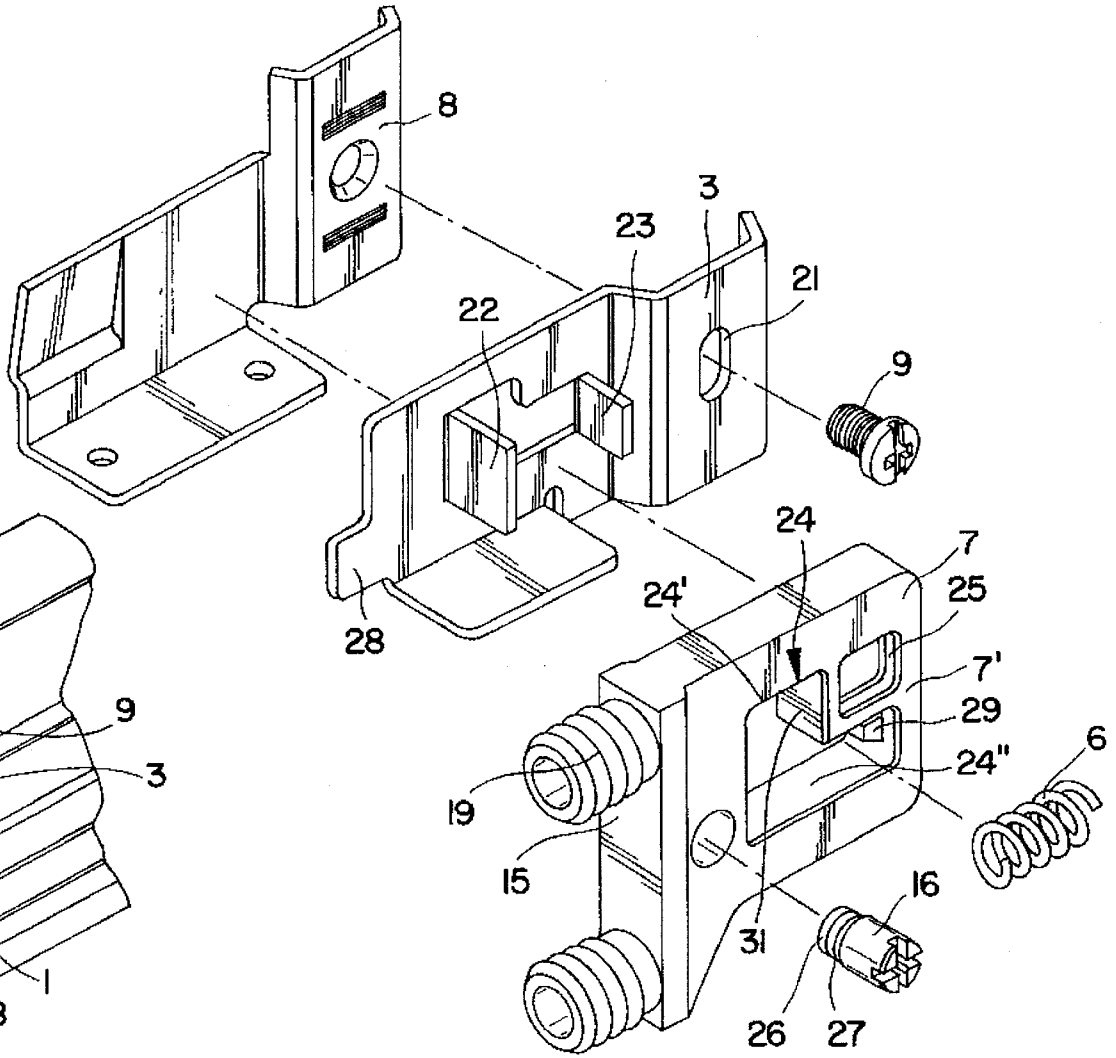
FIG. 5 is an exploded perspective view of the parts of the apparatus for securing the front panel.
Figure 4:
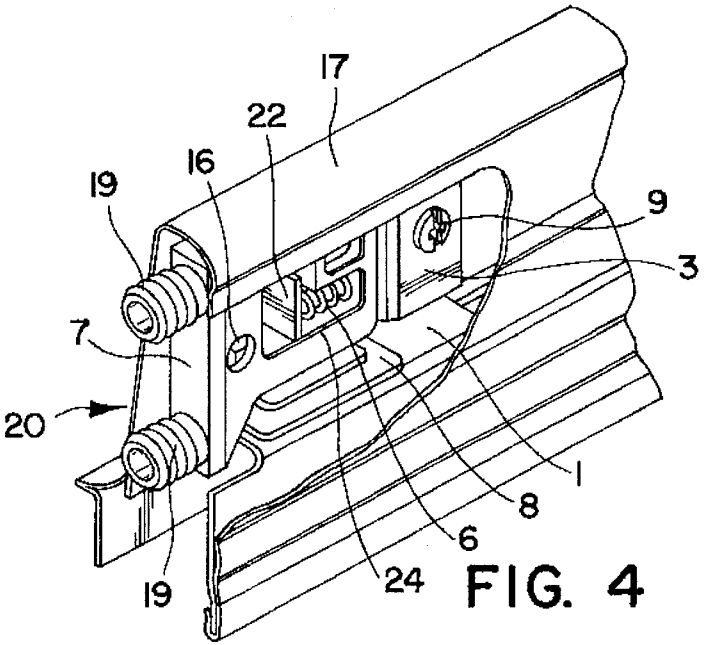
FIG. 4 is a perspective view of the front end of a drawer frame, with the apparatus for securing the front panel, the drawer frame being shown cut away.

FIG. 1 shows a furniture carcass having side walls 11 and an upper board or top panel 2, a drawer being guided in such furniture carcass. A front panel 4 of the drawer is secured to drawer sides or frames 17 by apparatus 20 according to the invention. Each drawer frame 17 has, at its front end, a cutout 18 in an outer cover web, and this enables a tool to gain access to the apparatus 20. A support rail 10 (FIGS. 2 and 3) is secured to the furniture side wall 11. A drawer bottom panel or base 5 is supported on a lower horizontal web of a pull-out rail 12. Between the support rail 10 and the pull-out rail 12 is arranged a central rail 13. One such rail assembly is provided on each side of the drawer. The drawer frame 17 is constructed as a double-walled frame, as can be seen in particular from FIGS. 2 and 3, and covers the rails 10, 12, 13 of the respective guide rail assembly and the apparatus 20 according to the invention for securing the front panel 4. With regard to function of the apparatus 20, the pull-out rail 12 is part of the drawer frame 17. The apparatus 20 can be mounted directly on the drawer frame 17 or on the pull-out rail 12.

The apparatus 20 according to the embodiment of FIGS. 2 to 8 of the invention has a holding part 7 which is secured to the front panel 4 by means of dowels 19. On the drawer side is provided a support part, which comprises a base plate 8 which is secured directly to an adapter 1 inserted into the drawer frame 17, and a receiving plate 3. The receiving plate 3 is secured in a vertically adjustable manner to the base plate 8 by means of a vertical adjustment screw 9 which projects through a slot 21. The receiving plate 3 has a front, broader tab 22 and a rear, narrower tab 23. The holding part 7 is provided with an L-shaped cutout 24 which has an upper narrower region 24' and a lower longer region 24". Furthermore, part 7 has an additional cutout 25 which enables access by a screwdriver to the vertical adjustment screw 9 when the fitting is mounted. Another adjustment screw 16 for lateral adjustment of the front panel 4 is mounted in the holding part 7. The adjustment screw 16 is mounted in a female thread in the part 7 and has a head 26 which delimits an annular groove 27. When the fitting is mounted, an upper edge of a flange 28 of plate 3 projects into the annular groove 27, so that by turning the adjustment screw 16 the holding part 7 is moved laterally in relation to the receiving plate 3 and the base plate 8.

When the fitting is mounted, the two tabs or flanges 22, 23 of the receiving plate 3 project into the cutout 24 of the holding part 7. A pressure spring 6 is mounted in the lower region 24", of the cutout 24 and is held there by a peg 29. Spring 6 is supported against the tab 22 of the receiving plate 3. As a result of the pressure spring 6, the holding part 7 is pushed rearwardly and thus the front panel 4 is pushed against front end edges of the drawer frame 17. If the drawer is pulled out by pulling the front panel 4, the holding part 7 is moved forwardly against the force of spring 6 until stop face 31 of the cutout 24 abuts against the tab 23 of the receiving plate 3. Then, the drawer frame 17 is carried along. The spring 6 is not compressed to an excessive extent.

If the drawer is pushed into the furniture carcass with excessive vigor, then the front panel 4 abuts against the front end edges of the side walls 11. The drawer can, however, together with the drawer frame 17 and the base plate 8 and the receiving plate 3, move further in opposition to the pressure of the pressure spring 6 relative to the holding parts 7 so that a certain damping effect occurs and the holding of the dowels 19 in the front panel 4 is not excessively stressed. Once the push-in energy is expended, the drawer frames 17 are pushed by way of the receiving plates 3 and the support plates 8 against the front panel 4 by the pressure springs 6.

Figure 6:
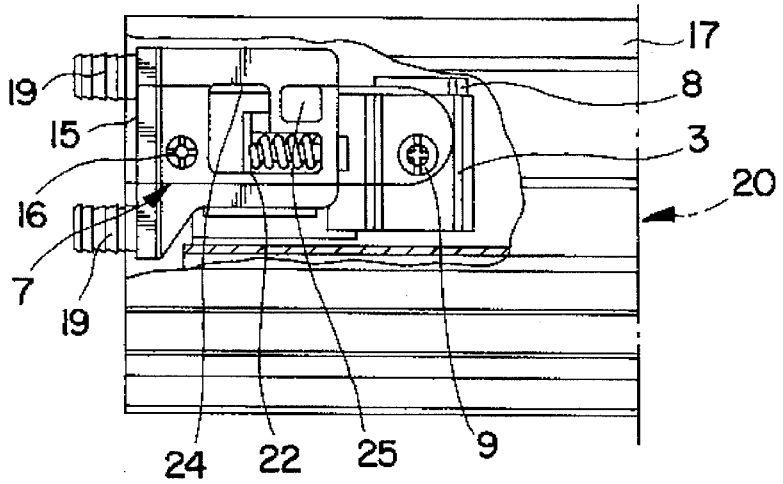
FIGS. 6 and 7 are side views of the drawer frame and the apparatus for securing the front panel.
Figure 7:
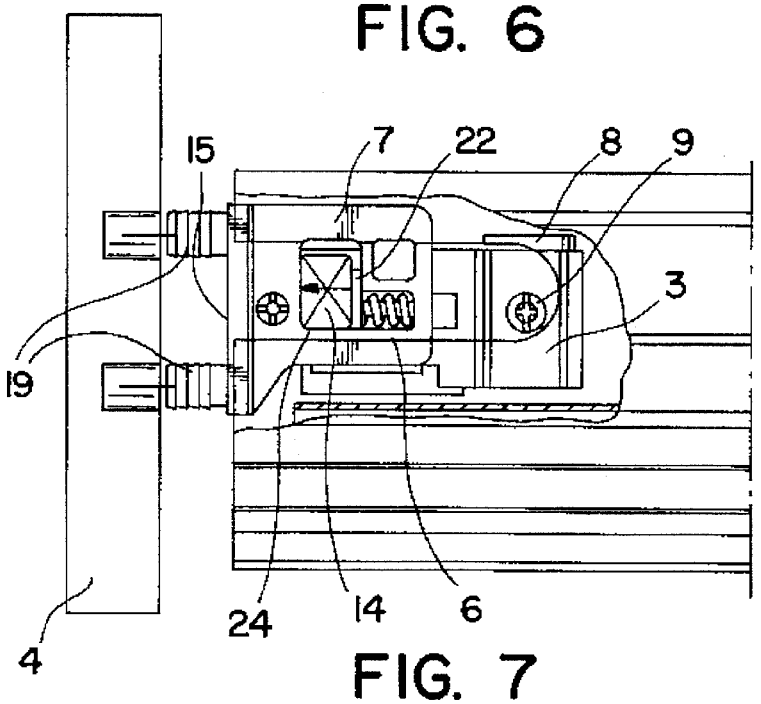
Figure 8:
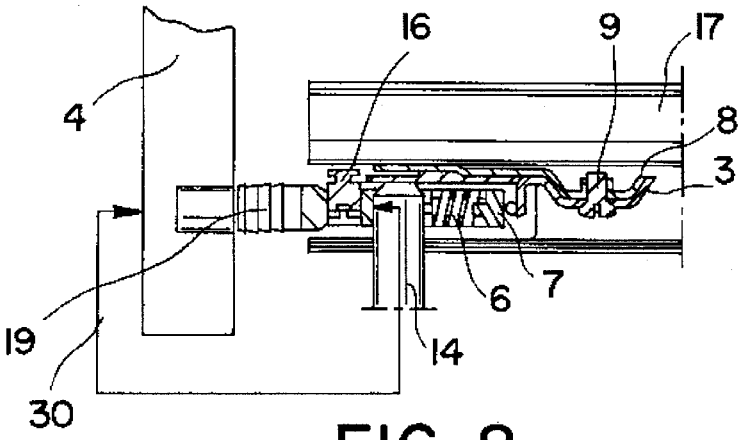
FIG. 8 is a horizontal section through the drawer frame and the apparatus for securing the front panel.
Figure 9:
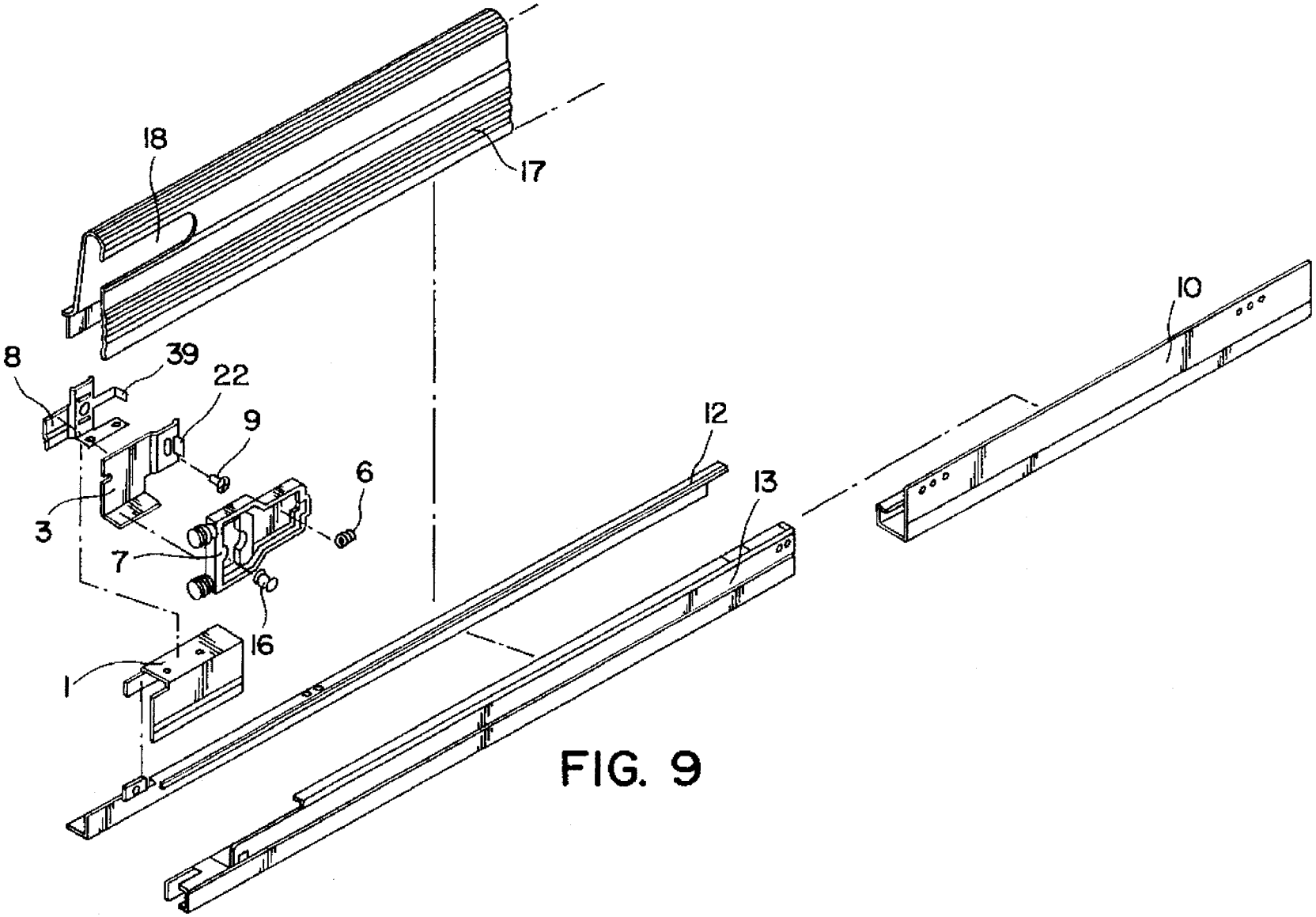
FIG. 9 is an exploded perspective view of a drawer frame with a pull-out guide and an apparatus for securing the front panel, in accordance with a further embodiment.
Figures 10, 11, 12:
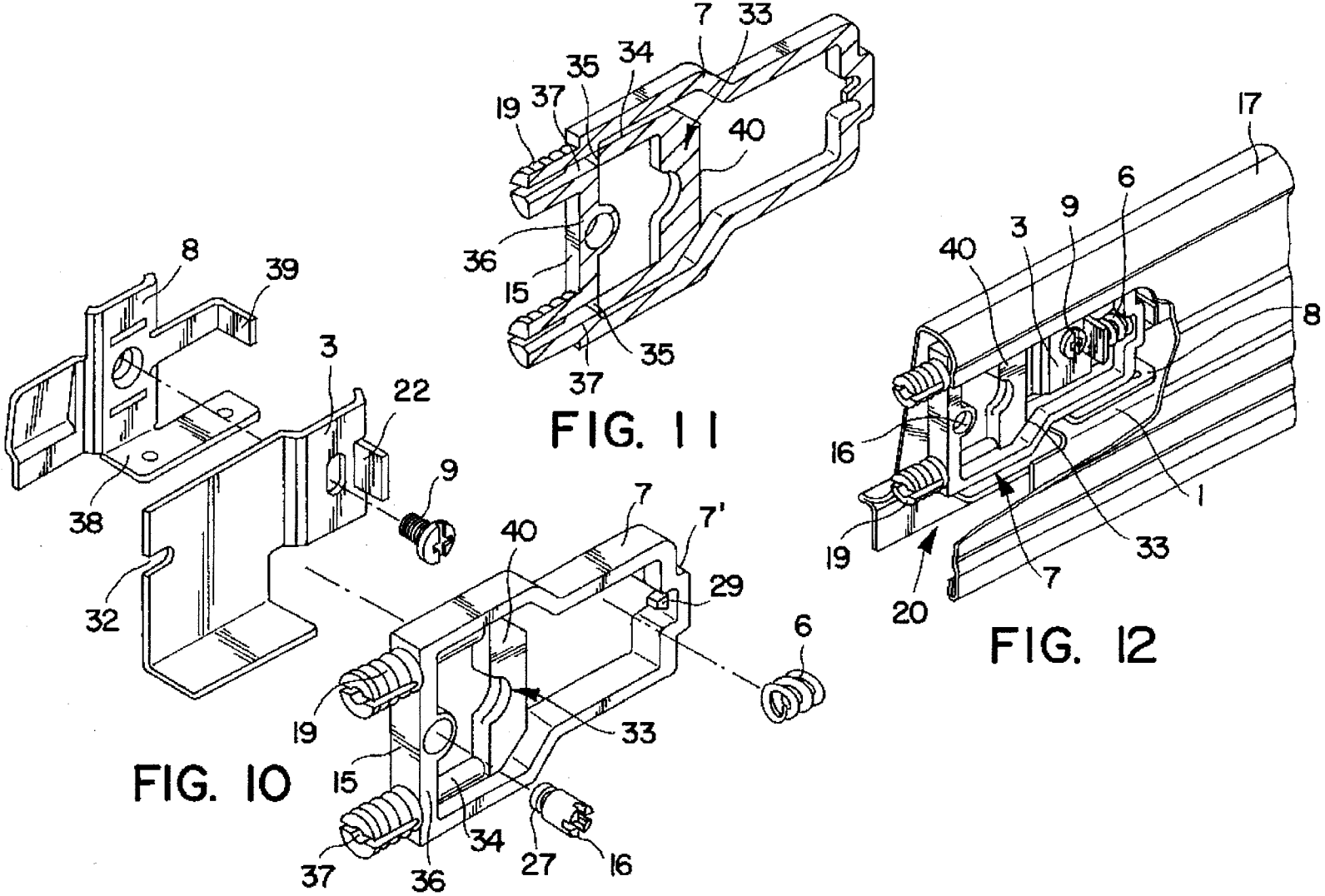
FIG. 10 is an exploded perspective view of the parts of the apparatus for securing the front panel.
FIG. 11 is a section in perspective through a holding part.
FIG. 12 is a perspective view of a front end of a drawer frame having inserted therein apparatus for securing the front panel.
Figure 13:
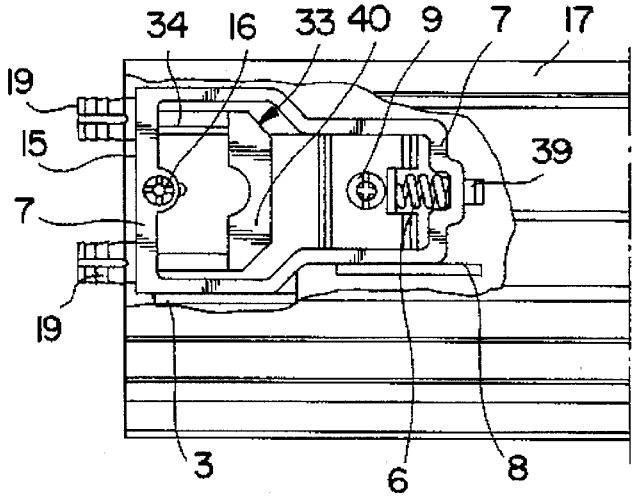
FIGS. 13 and 14 are side views of a drawer frame and the securing apparatus according to the invention.
Figure 14:
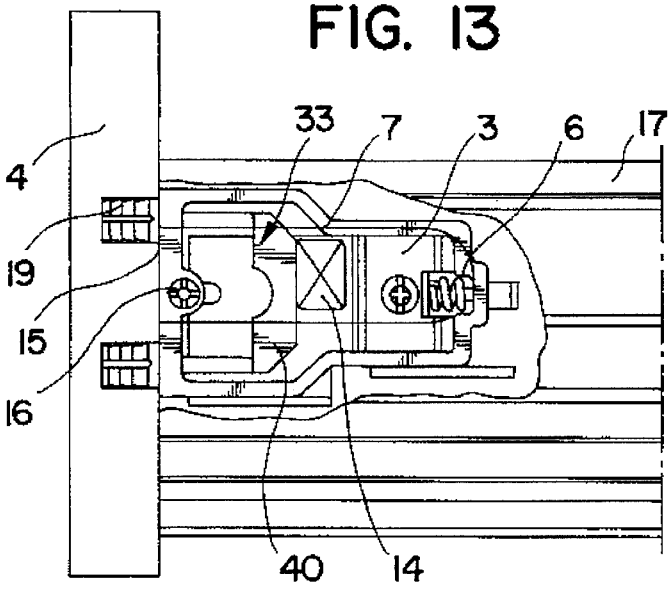
Figure 15:
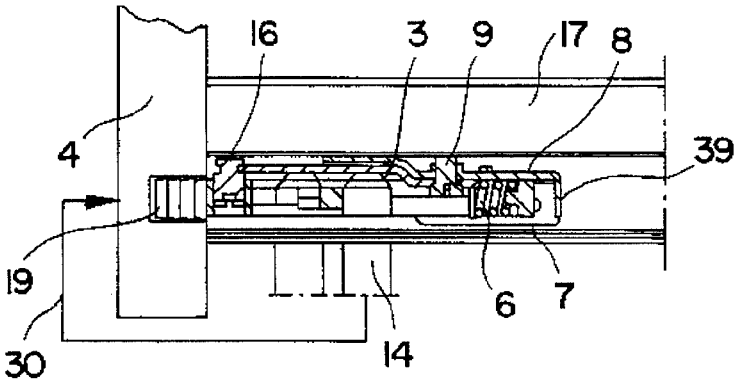
FIG. 15 is a horizontal section through a drawer frame and the apparatus according to the invention for securing the front panel.

When the drawer is assembled, the apparatus according to the invention is first mounted in the drawer frame 17. This situation is shown in FIG. 6. The holding part 7 is pushed into the rear end position by the pressure spring 6 so that stop face 15, by means of which the holding part 7 bears against the front panel 4 in the mounted position, is just behind the front termination or end face of the drawer frame 17. To mount the front panel 4, the holding part 7 is pushed forwardly out of the drawer frame 17 by means of a pressing ram 14, that is to say is brought into the position shown in FIG. 7. The stop face 15 in this case lies just in front of the end face of the drawer frame 17. In this situation, the front panel 4 can be pressed against the dowels 19 of the holding part 7. In FIG. 8, in this connection, the flow of the force of compression is designated by the reference numeral 30. If the front panel 4 is anchored on the dowels 19 of the holding part 7, then the pressing ram 14 is pulled out of the cutout 24 and the pressure spring 6 pushes the holding part 7 far enough into the drawer frame 17 for the front panel 4 to bear snugly against the end face of the drawer frame 17.

In the embodiment according to FIGS. 9 to 15, the holding part 7 is anchored in the front panel 4 by dowels 19 which are constructed as spreading plug-type dowels. The support part once again comprises a base plate 8 on which a receiving plate 3 is mounted in a vertically adjustable manner by means of the vertical adjustment screw 9. The receiving plate 3 is provided with a forwardly open slot 32 which, in the mounted positions receives the adjustment screw 16 for lateral adjustment. The edges of the slot 32 in this case project into the annular groove 27 of the adjustment screw 16. The holding part 7 is constructed in the shape of a bow and is provided at a rear vertical web 7' thereof with holding peg 29 for securing the pressure spring 6. As can be seen in particular from FIG. 11, a dowel spreading member 33 is arranged within the holding part 7. Spreading pins 34 of the spreading member 33 are connected to front web 36 of the holding part 7 by way of predetermined break-away portions or break points 35. The web 36 has formed therein spreading channels 37 which open into ends of the dowels 19.

To mount the drawer, the apparatus 20 is again mounted in the drawer frame 17, a flange 38 of the base plate 8 being secured to the adapter 1. The receiving plate 3 is secured to the base plate 8 by means of the vertical adjustment screw 9. The pressure spring 6 is supported at one side against the web 7' of the holding part 7 and at the other side against tab 22 of the receiving plate 3, and pushes the holding part 7 to the rear until the latter bears against a tab 39 of the base plate 8. Before mounting the front panel 4, the holding part 7 is in the position shown in FIG. 13, that is to say the stop face 15 is just behind the front end face of the drawer frame 17. To mount the front panel 4, the pressing ram 14 is introduced into the holding part 7 in such a way that it pushes against a yoke portion 40 of the spreading member 33 and thus pushes the holding I-art 7 out of the drawer frame 17. On compression, the front panel 4 is first pushed onto the dowels 19, whereupon the resistance becomes so great that the spreading pins 34 are severed from the holding part 7 at the predetermined break points 35. The spreading pins 34 consequently penetrate into the spreading channels 37 of the dowels 19, as a result of which the latter are spread outwardly in the front panel 4. Once the front panel 4 has been fixed on the dowels 19, the pressing ram 14 is withdrawn and the pressure spring 6 pushes the holding part 7 far enough into the drawer frame 17 for the front panel 4 to bear snugly against the end face of the drawer frame 17.

Figure 16:
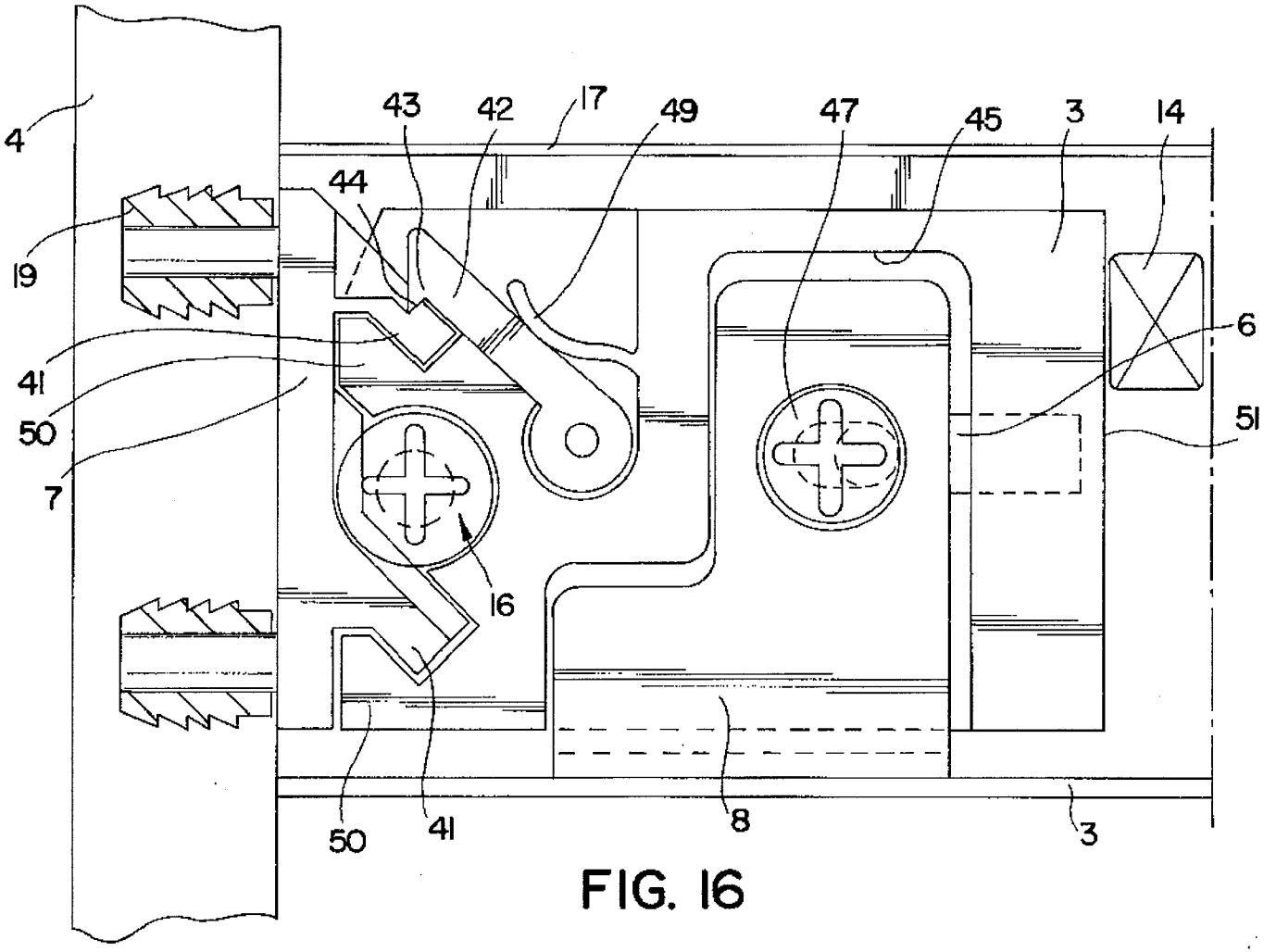
FIG. 16 is a side view of another embodiment of the apparatus for securing the front panel.
Figure 18:
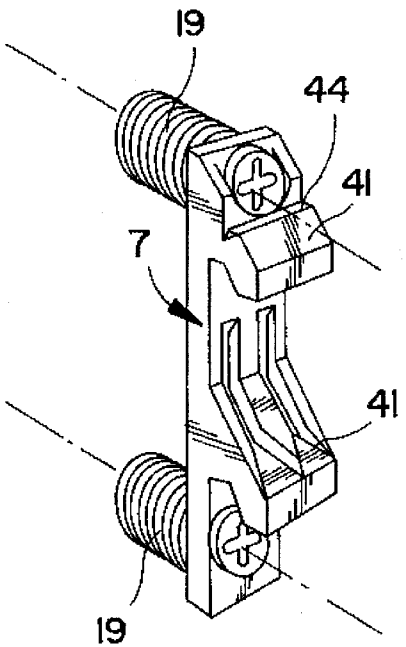
FIG. 18 is a perspective view of a holding part according to the embodiment of FIGS. 16 and 17.
Figure 17:
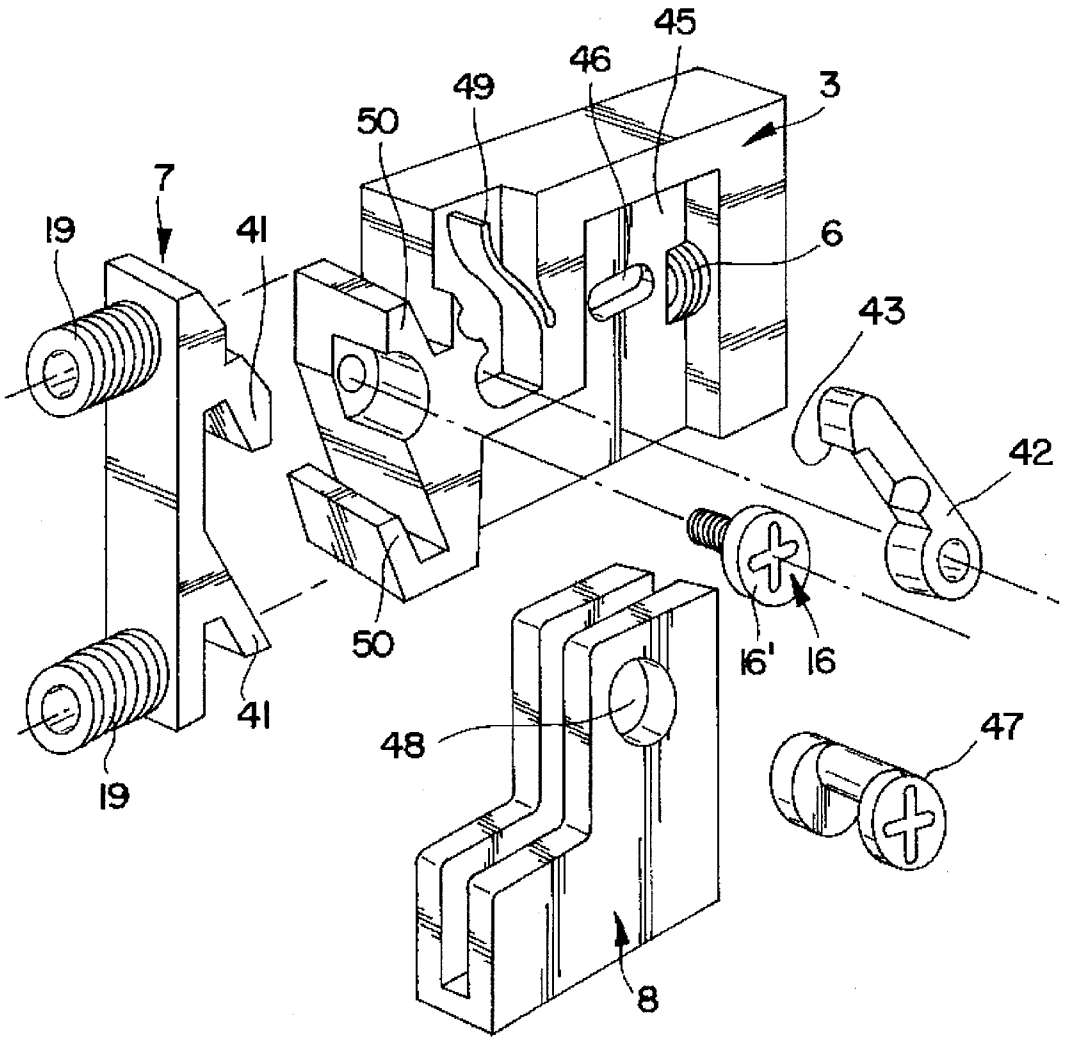
FIG. 17 is an exploded perspective view of individual parts of the apparatus for securing the front panel.

In the embodiment according to FIGS. 16 to 18, the apparatus according to the invention once again comprises a holding part 7 secured to the front panel and a support part formed by a base plate 8. A receiving plate 3 is provided between the holding part 7 and the base plate 8. The base plate 8 is L-shaped and the receiving plate 3 has a corresponding L-shaped cutout 45. In the mounted position, the base plate 8 is in the cutout 45. In the receiving plate 3 there is a horizontal slot 46 through which projects an eccentric 47 for vertical adjustment. The eccentric 47 is mounted in bearing openings 48 of the base plate 8. Instead of the eccentric 47, a vertical adjustment screw could just as well be provided. Furthermore, adjustment screw 16 for lateral adjustment is mounted in receiving plate 3 and has a head 16' which pushes laterally against the holding part 7. Pressure spring 6 is mounted in receiving plate 3 and is supported against the base plate 8, thus pushing the receiving part 3 rearwardly into the drawer frame 17. Holding part 7 is provided with hooks 41 by means of which is suspended in counter-hooks 50 of the receiving plate 3. On the receiving plate 3 is mounted a ratchet 42 which is pushed by a resilient tab 49 to hook by means of a lug 43 against a stop face 44 of the upper hook 41.

When the front panel 4 is mounted, the support part, that is to say the base plate 8 and the receiving plate 3, are mounted in the drawer frame 17. The holding part 7 is secured to the front panel 4. The front panel 4 is now suspended in the receiving plate 3 by means of the holding part 7, the hooks 41 being moved from the front top rearwardly and downwardly. As a result of the oblique alignment of the hooks 41 and the counter-hooks 50, the receiving plate 3 is drawn forwardly in opposition to the force of the pressure spring 6 when the front panel 4 is suspended until the hooks 41 have latched in fully. Then, the pressure spring 6 always pushes the front panel 4 snugly against the front end face of the drawer frame 17. By means of its latching lug 43, the ratchet 42 prevents the front panel 4 from becoming unhooked when this is not desired. The receiving plate 3 is thus rigidly connected to the holding part 7 but is movable relative to the base plate 8.

If the drawer is unintentionally pushed into the furniture carcass too vigorously and the front panel 4 abuts against the front end edges of the furniture side walls 11, then the base plate 8 together with the drawer frame 17 can move rearwardly into the furniture carcass in opposition to the pressure of the spring 6 by a certain amount relative to the receiving plate 3 and thus relative to the front panel 4. Thus, the drawer is moved away from the front panel 4 to a certain extent. Once the push-in energy is expended, the drawer frames 17 are pushed against the front panel 4 again by the pressure springs 6.

The front panel 4 also can be mounted in such a way that the holding parts 7 are suspended in the receiving plates 3 and the front panel 4 is pushed onto dowels 19. The counter-pressure is again produced by a pressing ram 14 which pushes against a stop 51 of the receiving plate 3.

The apparatus 20 according to the embodiment of FIGS. 19 to 30*a* of the invention has a holding part 7 which is secured to the front panel 4 by dowels or screws. On the drawer side there is provided a receiving plate 3 which is secured directly to the adapter 1 inserted into the drawer frame 17. The adapter 1 is preferably welded or riveted to the pull-out rail 12. The adapter 1 and the receiving plate 3 form the support part. The holding part 7 comprises a stop part 51, which can be secured directly to the front panel 4, and an insertion part 52. The stop part 51 and the insertion part 52 are connected by the vertical adjustment screw 9 which projects through a slot in the insertion part 52 and can be screwed into a flange 54 of the stop part 51. The lateral adjustment screw 16 is furthermore mounted in the insertion part 52. The receiving plate 3 has a housing 55 into which the insertion part 52 can be inserted when the front panel 4 is mounted.

A tilt lever 60 is mounted by a pin 56 on a vertical web 3' of the receiving plate 3. Articulated to the tilt lever 60 is a rod 57 which has a free end projecting through a hole 58 in a flange 59 of the receiving plate 3 and on which the spring 6, which is a pressure spring, is mounted. The locking bar 61 also is mounted on the vertical web 3' of the receiving plate 3. The locking bar 61 is constructed as a two-armed lever and also is mounted on the pin 56. A lower lever arm 61' is Z-shaped and projects through a slot 62 in the web 3' of the receiving plate 3. An upper arm 61" of bar 61 has an angled stop tab 63. The locking bar 61 is constructed to be resilient so that before the front panel 4 or the holding part 7 is suspended in the receiving plate 3 the upper arm 61" is pushed back and abuts laterally against the tilt lever 60. The tilt lever 60 is provided with a notch 64. The holding part 7 or the insertion part 52 has an upwardly curved web 65.

Figure 19:
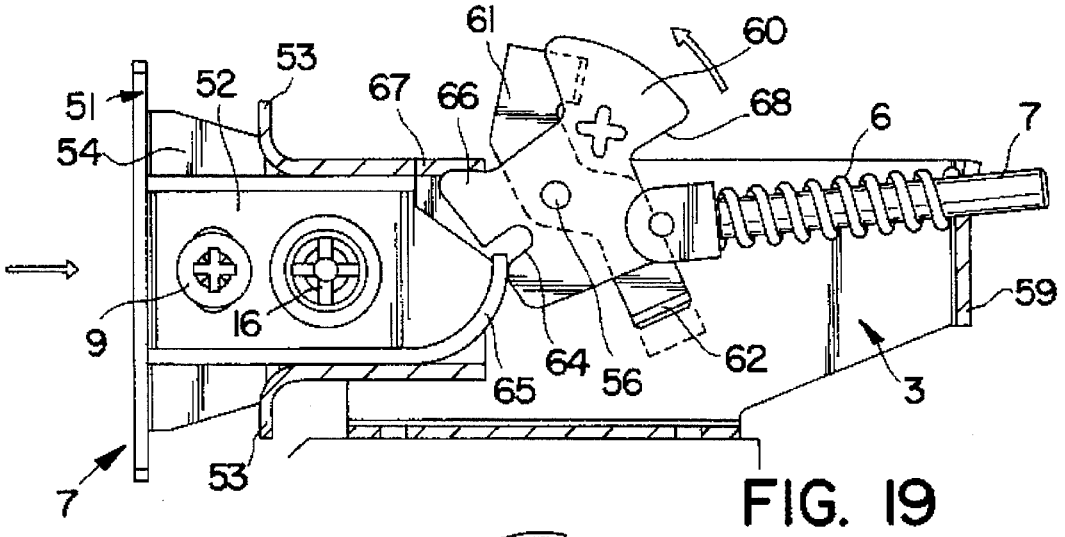
FIGS. 19 to 21 are side views of a further embodiment of the apparatus according to the invention in different stages of suspension of the front panel.
Figure 20:
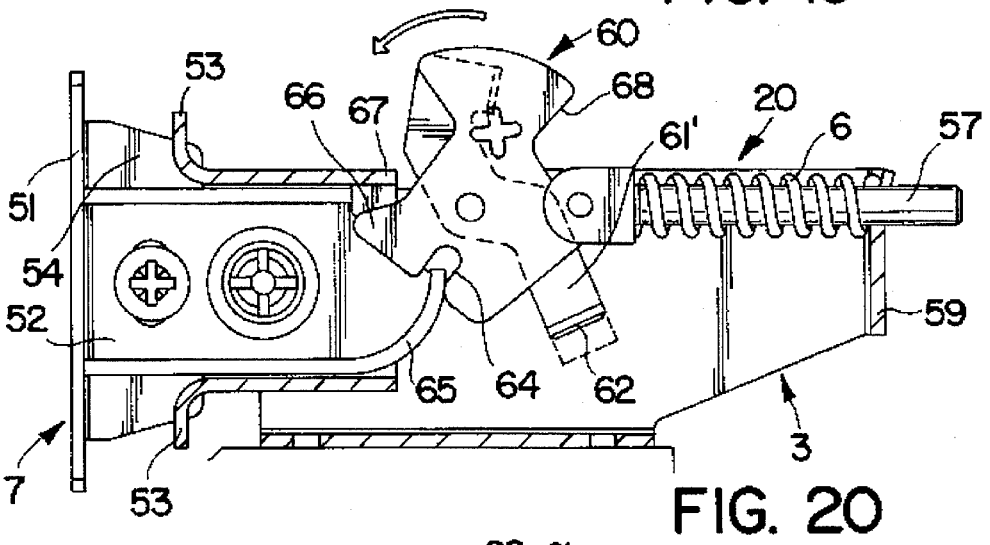
Figure 21:
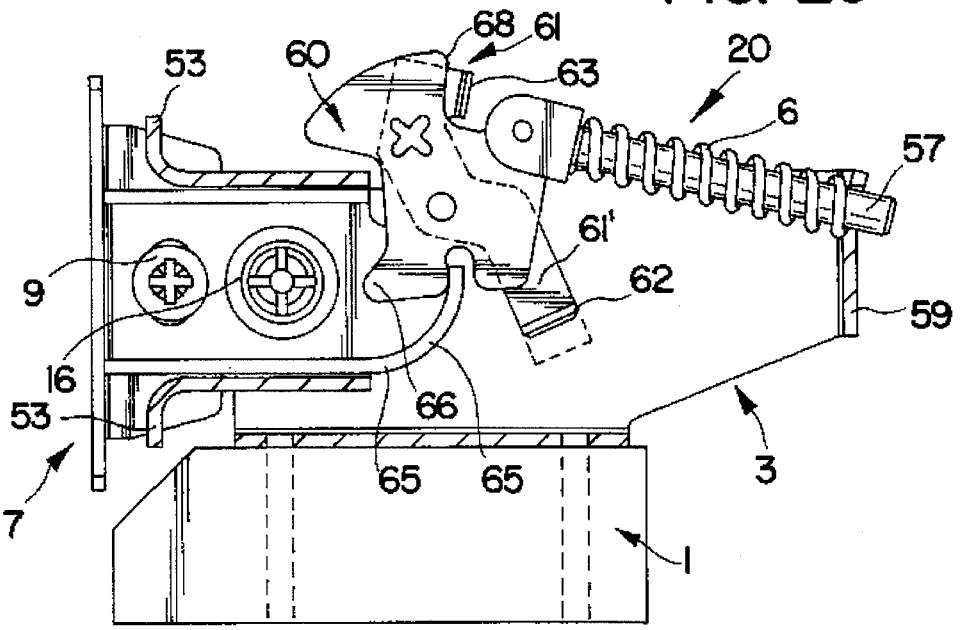
Figure 22:
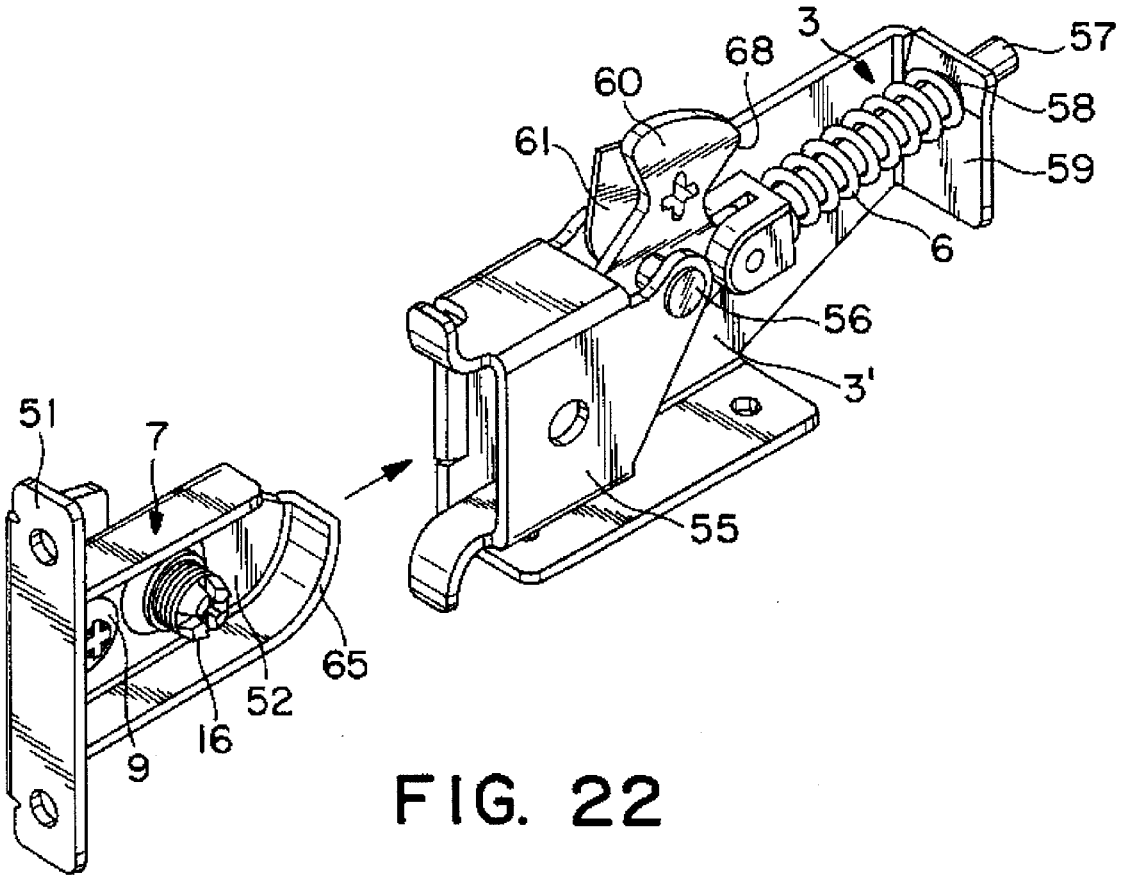
FIG. 22 is an exploded perspective view of parts of such apparatus before suspension of the front panel.
Figure 23:
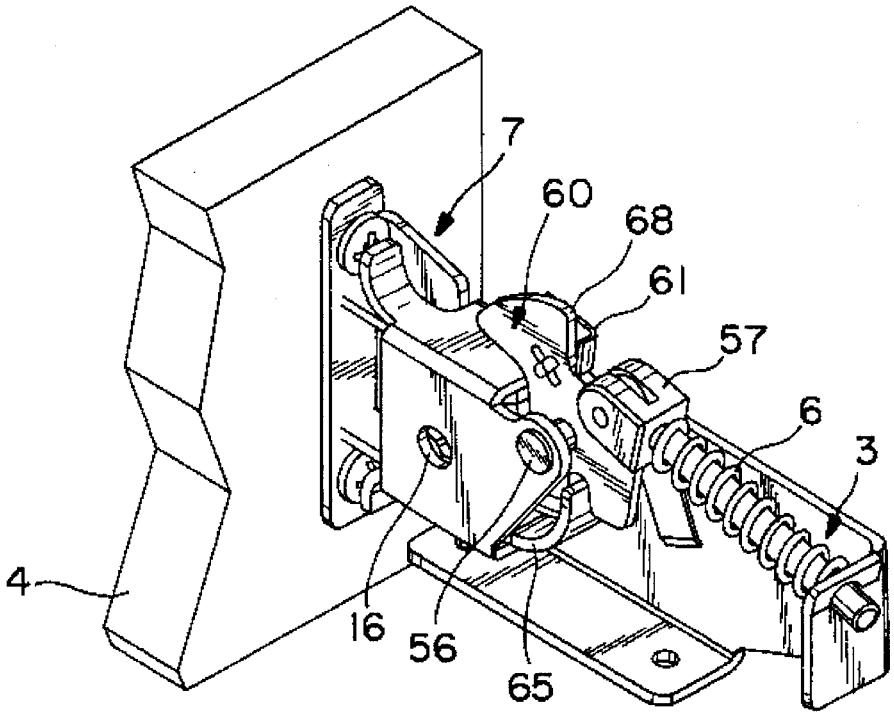
FIG. 23 is a perspective view of the parts of the apparatus with a holding part suspended in a support part.
Figure 25:
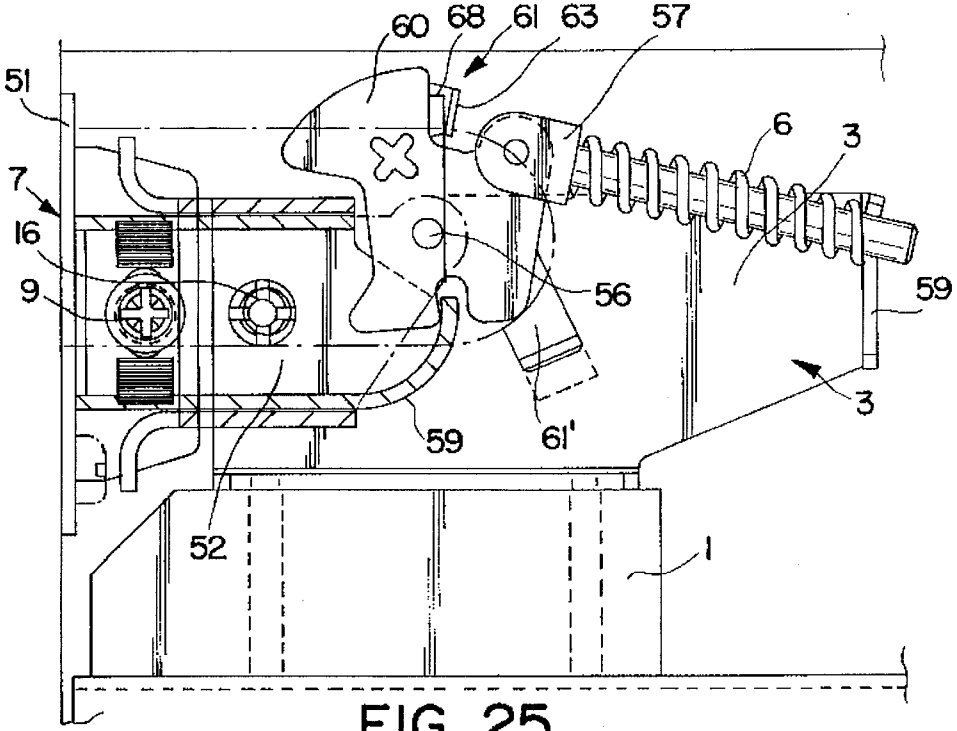
FIG. 25 is a further side view of the apparatus with the front panel suspended.
Figure 26:
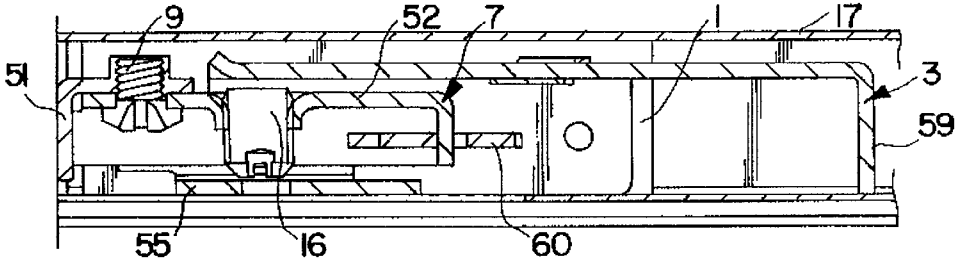
FIG. 26 is a plan view of the apparatus of FIG. 25.
Figure 24:
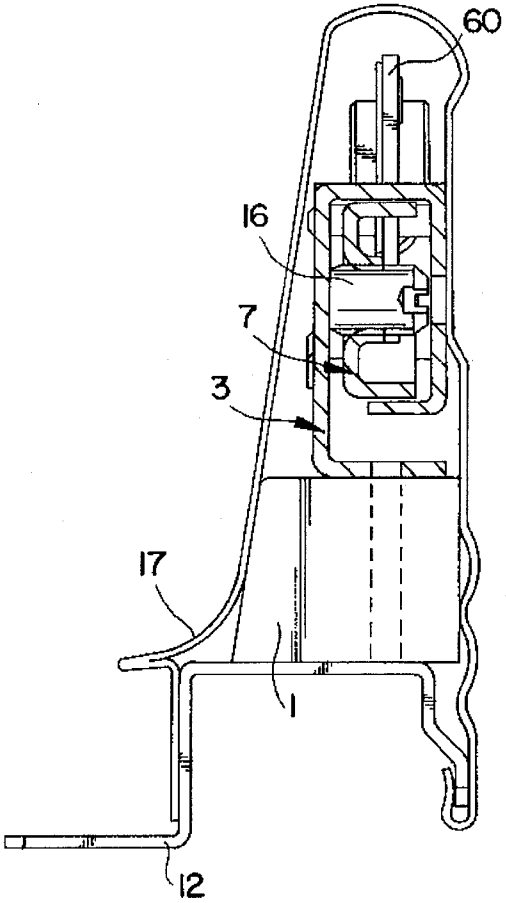
FIG. 24 is an end view of a drawer frame.
Figure 27:
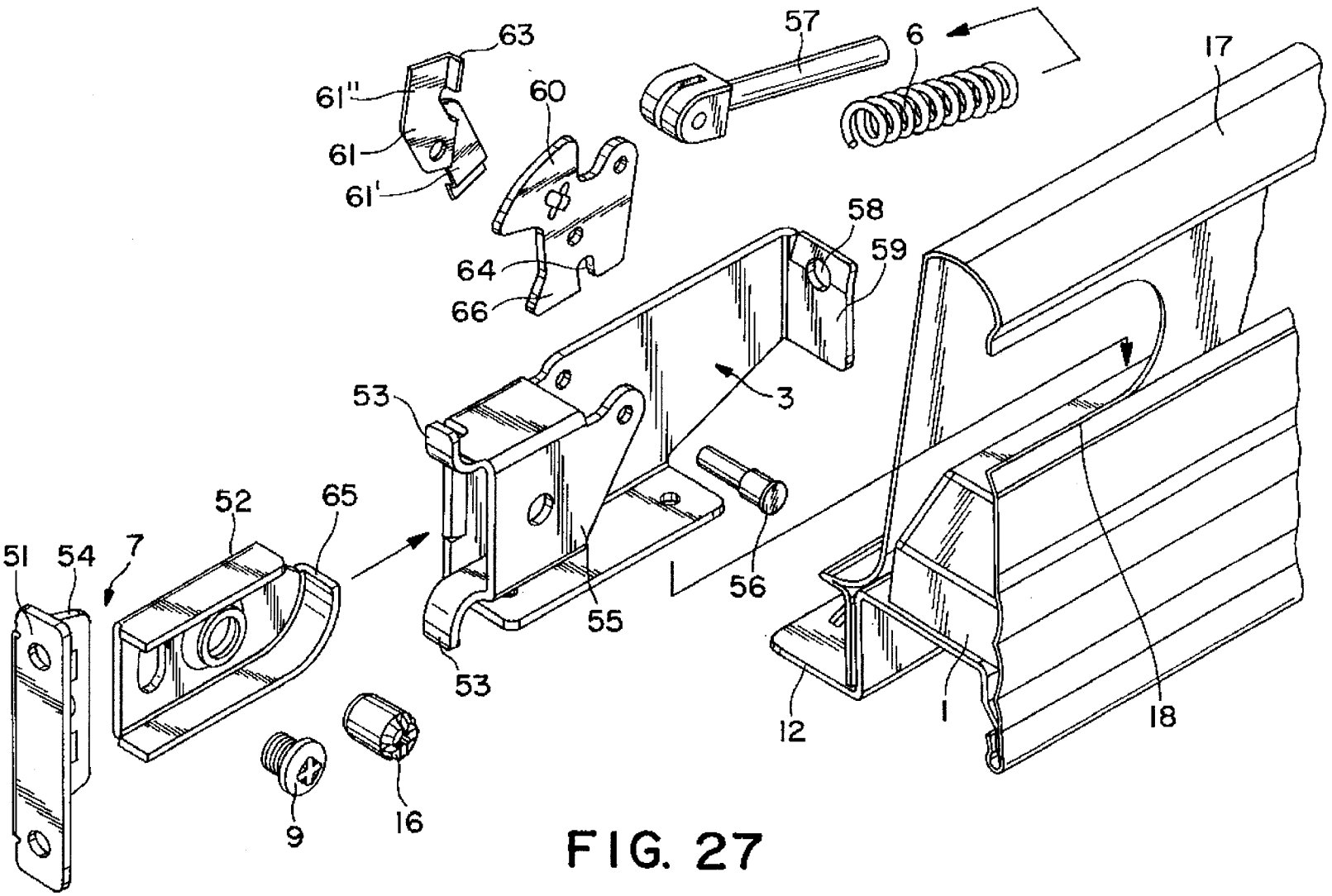
FIG. 27 is an exploded perspective view of the parts of the apparatus and of the drawer frame.
Figure 31:
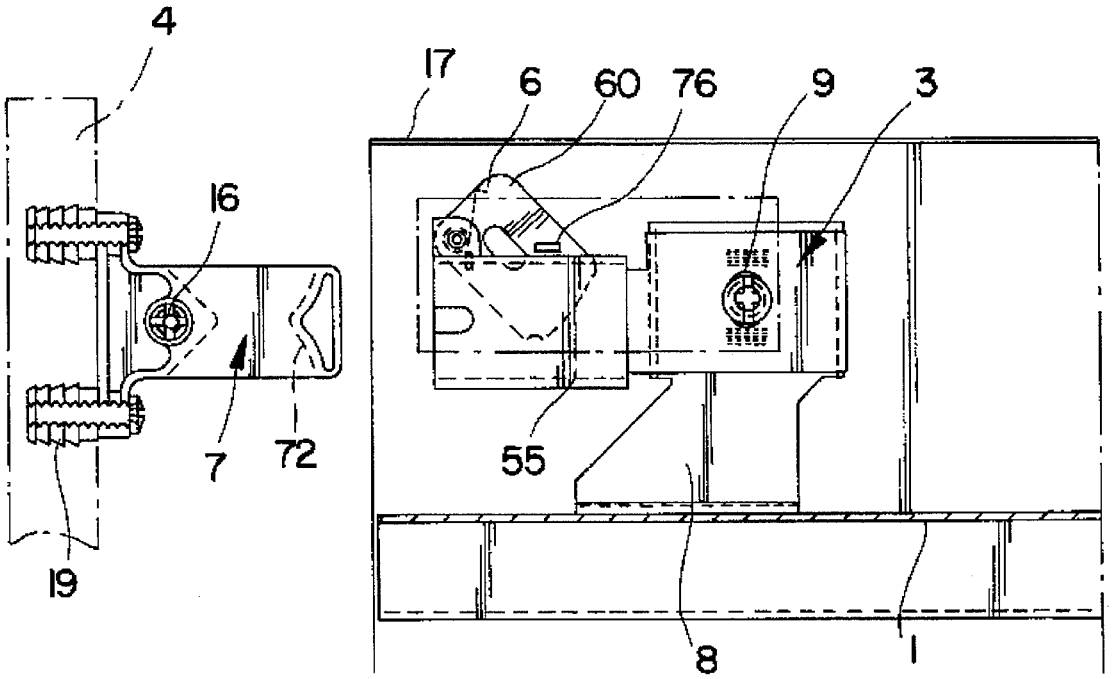
FIGS. 31 to 34 are side views of a further embodiment of the apparatus according to the invention in various stages of suspension of the front panel.
Figure 32:
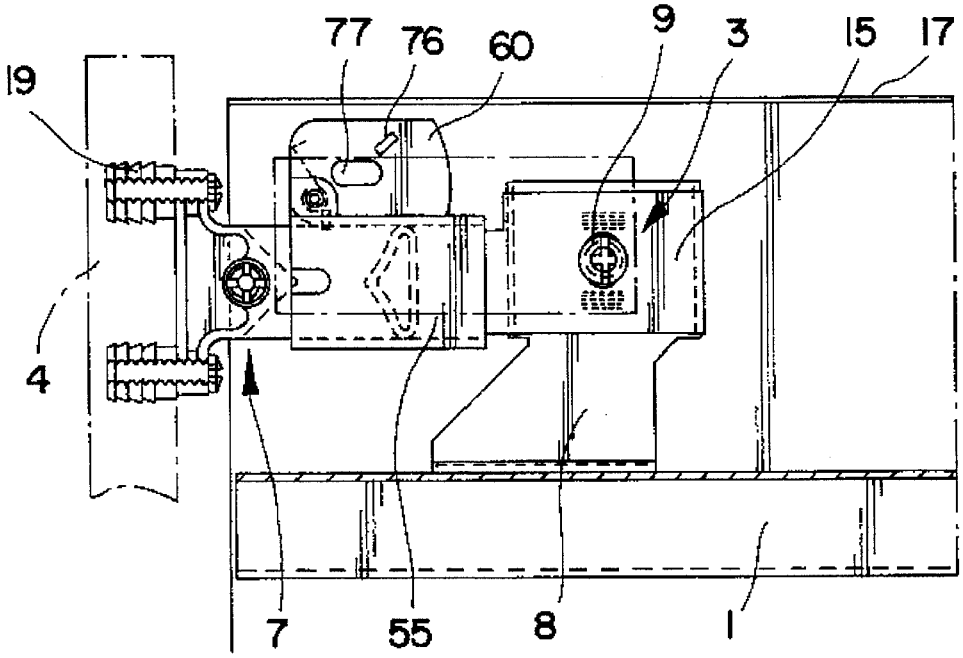

Before the front panel 4 is suspended, the tilt lever 60 is in the position shown in FIG. 19, that is to say the spring 6 urges the tilt lever 60 clockwise until it abuts lug 66 thereof against upper web 67 of the housing 55. Once the front panel 4 has been mounted and the insertion part 52 of the holding part 7 has been inserted into the housing 55 of the receiving plate 3, the upper edge of the curved web 65 abuts against the tilt lever 60 at the notch 64 and turns the tilt lever 60 counterclockwise in opposition to the action of the spring 6. However, should the spring 6 overcome its dead center position shown in FIG. 20, the tilt lever 60 is turned counterclockwise further by the spring 6, and at the same time the holding part 7 is carried along by way of the horizontal web 65 latching into the notch 64 and being drawn into the housing 55 of receiving plate 3. During this, the tilt lever 60 is tilted by the stop tab 63 of the locking bar 61 which projects behind the tilt lever 60 and prevents the tilt lever 60 from turning back again. The stop tab 63 is however spaced from a rear stop edge 68 of the tilt lever 60. As a result of this, the tilt lever 60 can be turned back again between the stop edge 68 and the stop tab 63. In this way, the spring 6 acts as a shock absorber for the holding part 7. If, for example, the drawer is pushed into the furniture carcass too vigorously and the front panel 4 abuts against the front end faces of the side walls 11, then the receiving plate 3 can move in opposition to the spring pressure of the spring 6 over the spacing between the stop edge 68 and the stop tab 63 of the locking bar 61 away from the holding part 7, after which it is then drawn back again by the spring 6. In this way, less force acts on the dowels 19 by means of which the stop part 51 is anchored in the front panel 4.

If the front panel 4 is to be released from the drawer frame 17 and thus the holding parts 7 are to be released from the receiving plates 3, a screwdriver 69, as shown in FIGS. 28 to 30*a*, is introduced into a cross-shaped slot of the tilt lever 60. The tip of the screwdriver pushes the locking bar 61 laterally away from lever 50 and pushes the stop tab 63 out of the path of rotation of the tilt lever 60. The tilt lever 60 can now be turned clockwise by means of the screwdriver 69, so that the notch 64 is turned forwardly and releases the web 65 of the insertion part 52. The stop tab 63 of the locking bar 61 abuts laterally against the tilt lever 60 during this operation.

In the embodiment according to FIGS. 31 to 38, the vertical adjustment screw 9 is used to screw the receiving plate 3 to the base plate 8 that is secured to the adapter 1 by means of rivets or screws. The vertical adjustment screw 9 projects through a slot in the receiving plate 3 and is held in the base plate 8 so that housing 55 of the receiving plate 3 is vertically adjustable. The housing 55 has a slot 70 within which the tilt lever 60 is pivotal. The tilt lever 60 is again mounted on a pin 56, that is mounted on flanges 71 above the housing 55. The lateral adjustment screw 16 is mounted in the holding part 7 and is supported against at least one side wall of the housing 55 when the holding part 7 is pushed into the housing 55. The holding part 7 is constructed in one piece and in the manner of a housing. It has two support faces 72 which are curved and are arranged in mirror image symmetry so that when the holding part 7 is fixed to the front panel 4 it does not matter which side of the holding part 7 faces upwardly. The tilt lever 60 is urged by a leg spring 6 downwardly in a clockwise direction.

Figure 33:
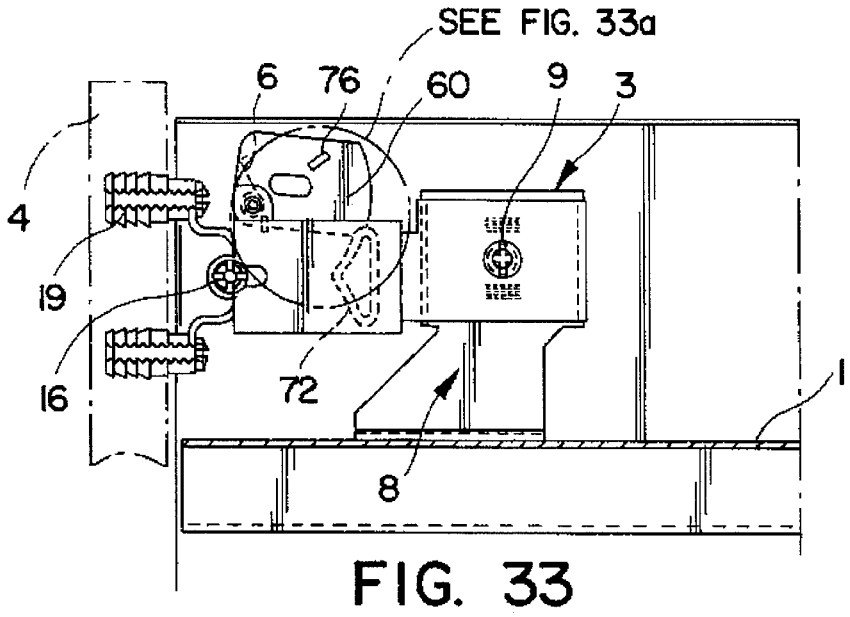
Figure 33A:
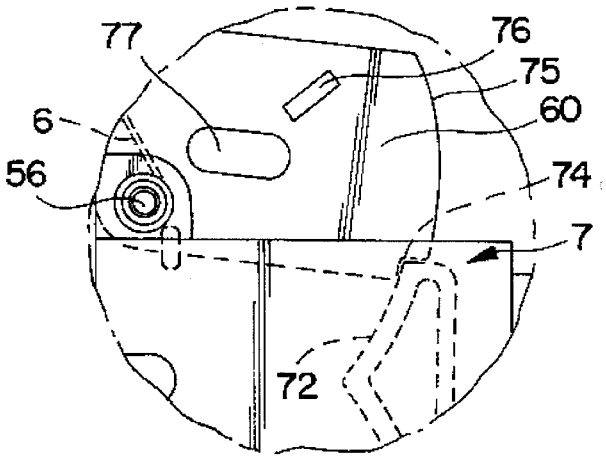
Figure 34:
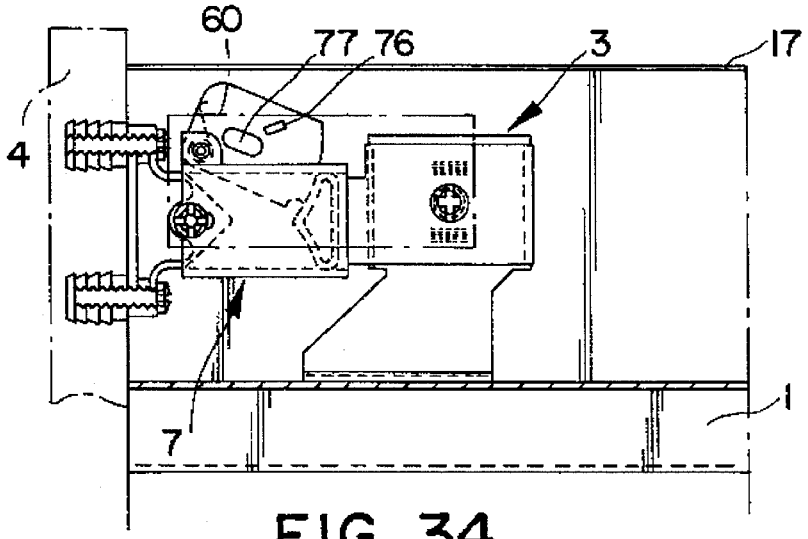
Figure 35:
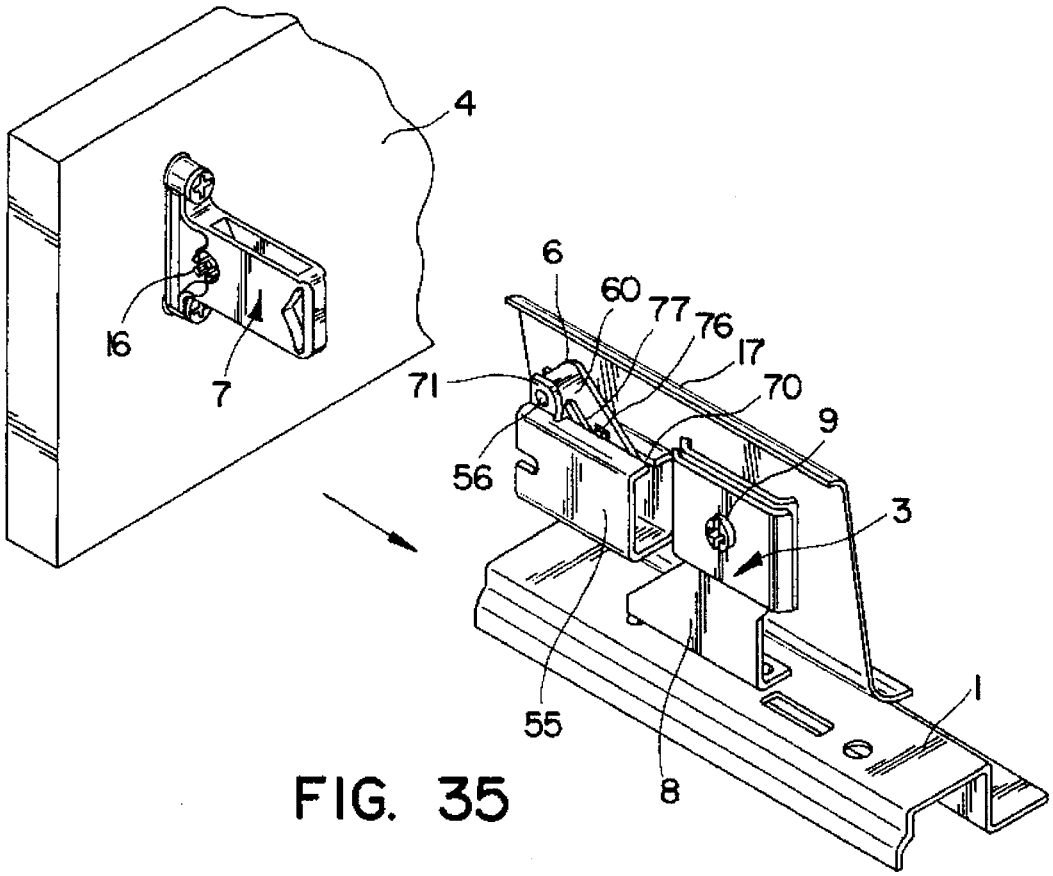
FIG. 35 is a perspective view of the apparatus before suspension of the front panel.
Figure 36:
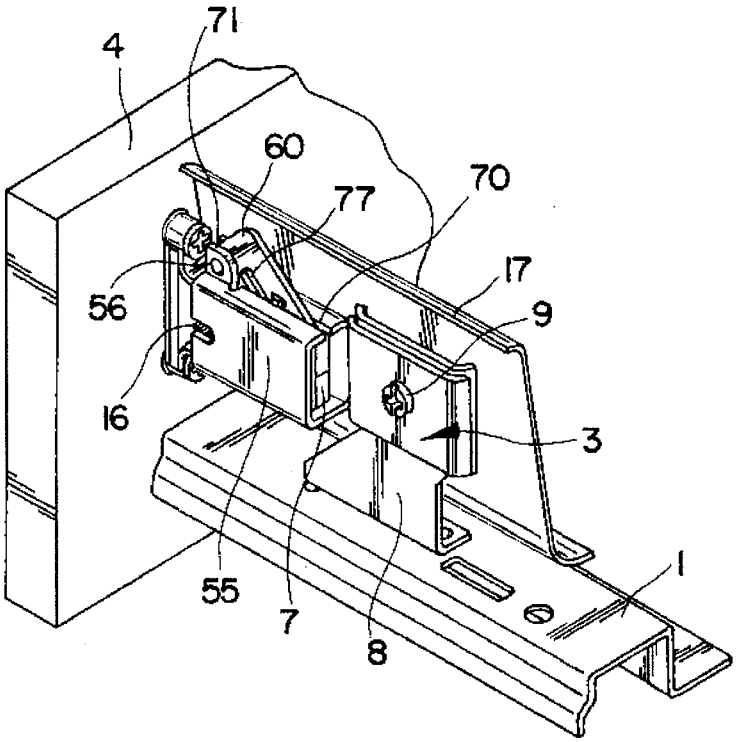
FIG. 36 is a perspective view of the apparatus with the front panel suspended.
Figure 37:
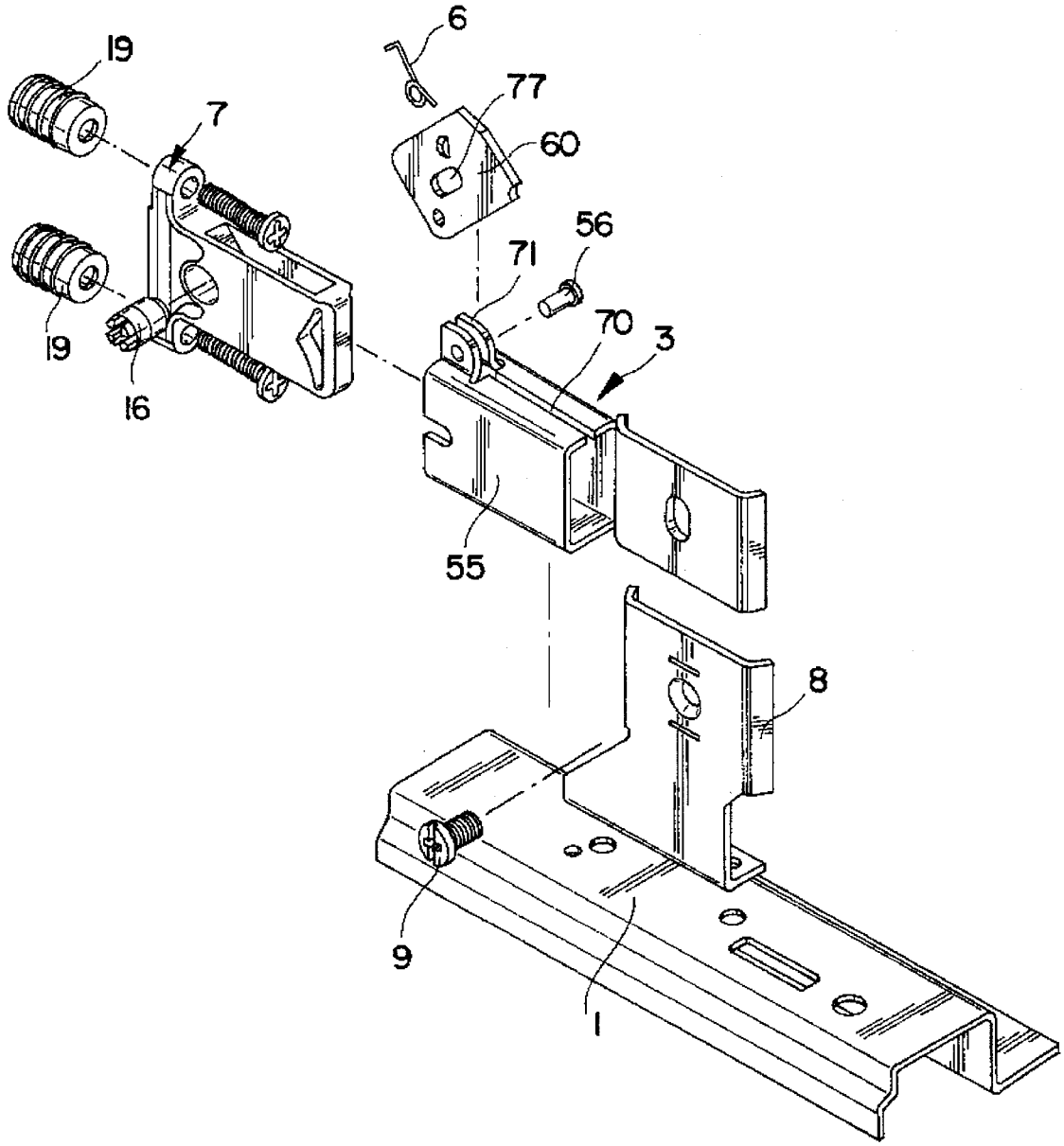
FIG. 37 is an exploded perspective view of individual parts of the apparatus.
Figure 38:
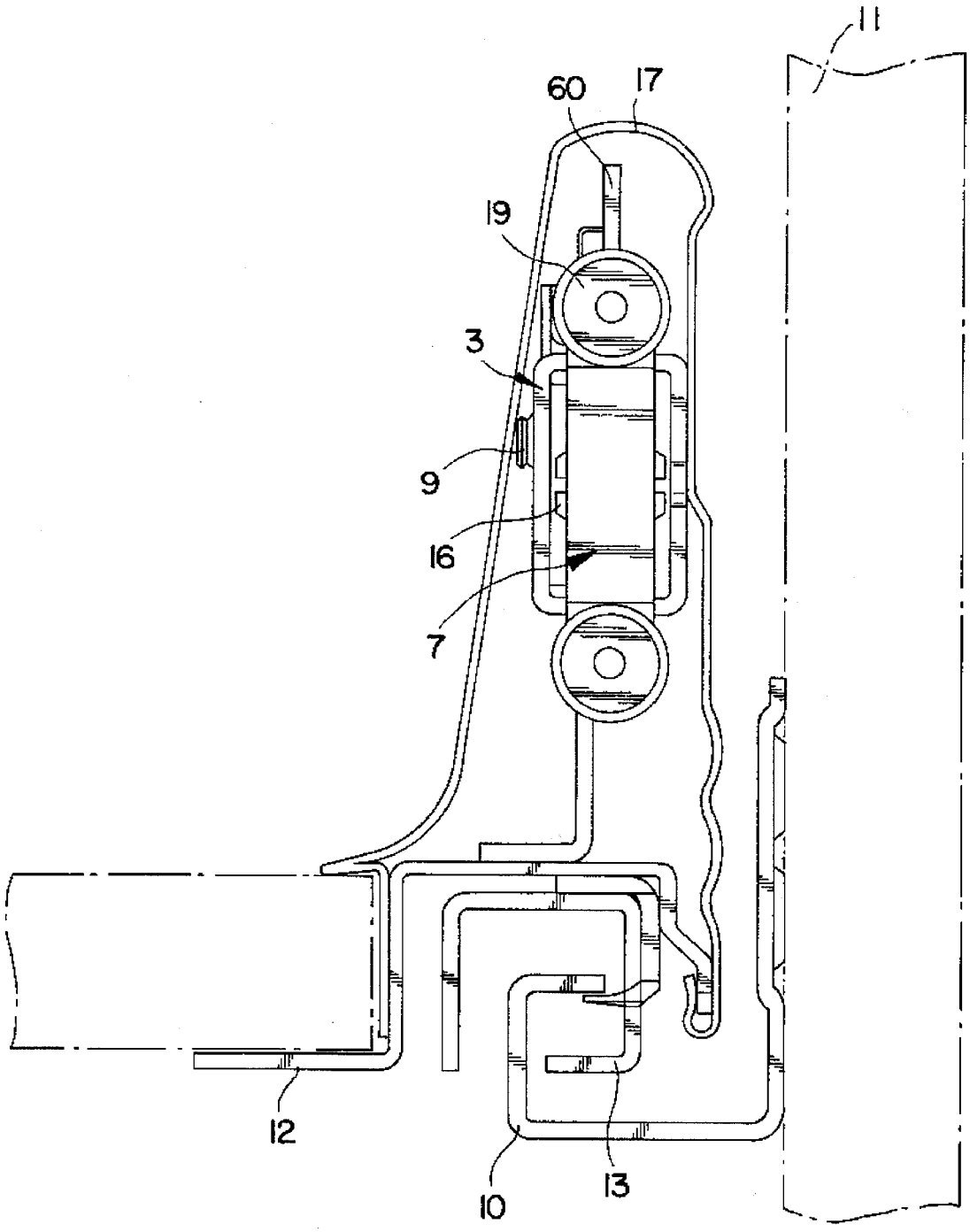
FIG. 38 is an end view of a drawer frame with an apparatus according to FIGS. 31 to 37.

FIGS. 31 to 34 show the mounting procedure for the front panel 4. Before the holding part 7 is inserted into the housing 55, the tilt lever 60 is pushed by spring 6 into the position shown in FIG. 31. As a result of the insertion of the holding part 7 (FIG. 32), the tilt lever 60 is pushed upwardly until the upper support face 72 latches into notch 74 at rear front lower corner of the tilt lever 60 (FIGS. 33, 33*a*). As a result, the front panel 4 is held against the receiving plate 3, albeit with play. In this position, precise positioning of the front panel 4 is possible. When the front panel 4 is in the desired position, the front panel 4 is pushed further against the drawer frame 17 and the holding part 7 is pushed further into the housing 55 until the tilt lever 60 can be pivoted by the spring 6 downwards into the position shown in FIG. 34, as a result of which front edge 75 thereof pushes against the support face 72. The front panel 4 is now fixed. The tilt lever 60 has another stop 76, which prevents the tilt lever 60 from pivoting too far into the housing 55.

Furthermore, the tilt lever 60 is provided with a slot 77 which enables a screwdriver or a similar tool to act in order to turn the tilt lever 60 counterclockwise and to release lever 60 from engagement with the support face 72. The holding part 7 then can be withdrawn from the housing 55 and from the receiving plate 3, and the front panel 4 can be released from the drawer frames 17.

In the embodiment according to FIGS. 39 to 46, the receiving plate 3 once again is screwed to a bracket 8 which can be secured directly to the adapter 1. The tilt lever 60 is mounted on the receiving plate 3. The receiving plate 3 again has at the rear an angled tab 59 against which the spring 6 is supported. The angled tab 59 is provided with a hole 58 through which projects rod 57 which supports the spring 6 and which acts directly on the tilt lever 60. The receiving plate 3 is secured by means of vertical adjustment screw 9 which projects through a slot in the receiving plate 3 and can be screwed into the bracket 8. Tilt segment 60 has an upper notch 79 and a lower notch 64. Above the tilt lever 60 is locking bar 61 which has at a rear end thereof a punched hole through which extends the rod 57. At a front end of locking bar 61 is a stop tab 63 which latches into the notch 79 of the tilt lever 60 when the front panel 4 is secured.

The holding part 7 is secured directly to the front panel 4. The adjustment screw 16 for lateral adjustment is mounted in the holding part 7. The receiving plate 3 has upper and lower horizontal web 67, 80 between which the holding part 7 can be inserted. A lateral delimiting web 81 adjoins the upper horizontal web 67 so that the holding part 7 is positioned between the webs 67, 80, 81 and the actual receiving plate 3. The receiving plate 3 and the web 81 have punched holes through which projects pin 56 which forms the spindle for the tilt segment 60. The holding part 7 is provided with a hook 84.

Figure 39:
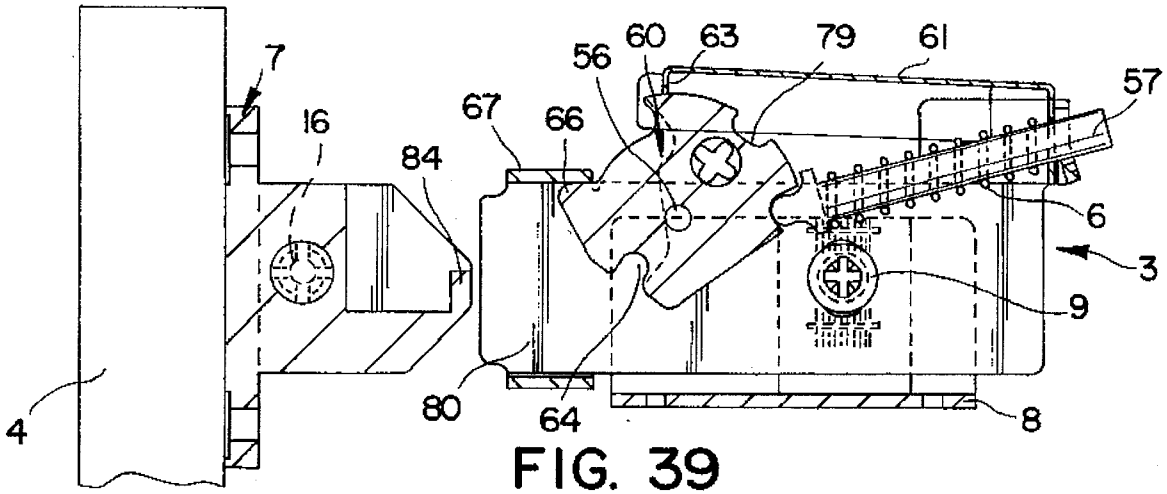
FIG. 39 is a side view of a further embodiment of the apparatus according to the invention, before suspension of the front panel.
Figure 41:
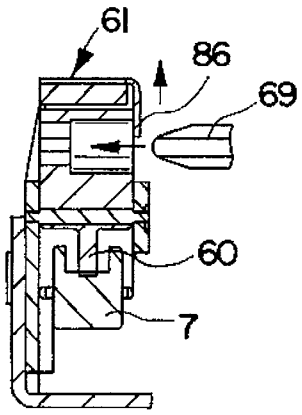
FIG. 41 is a section of the apparatus of FIG. 40.
Figure 40:
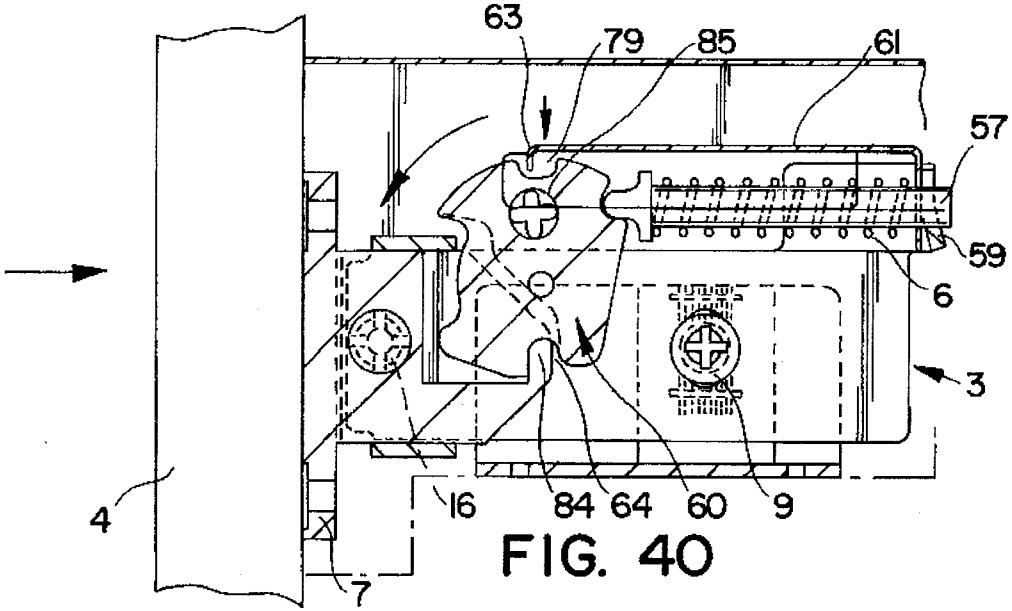
FIG. 40 is a similar side view with the front panel suspended.
Figure 43:
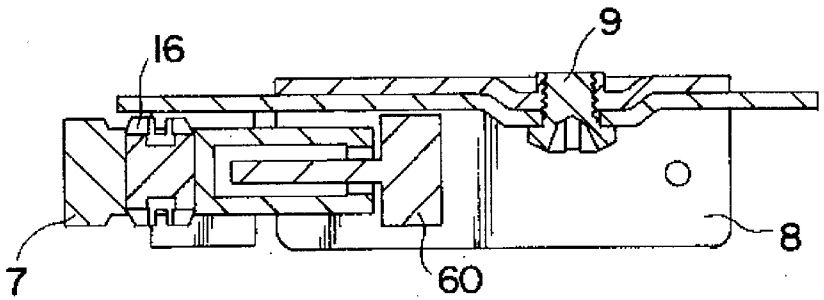
FIG. 43 is a horizontal section through the apparatus according to the invention.
Figure 42:
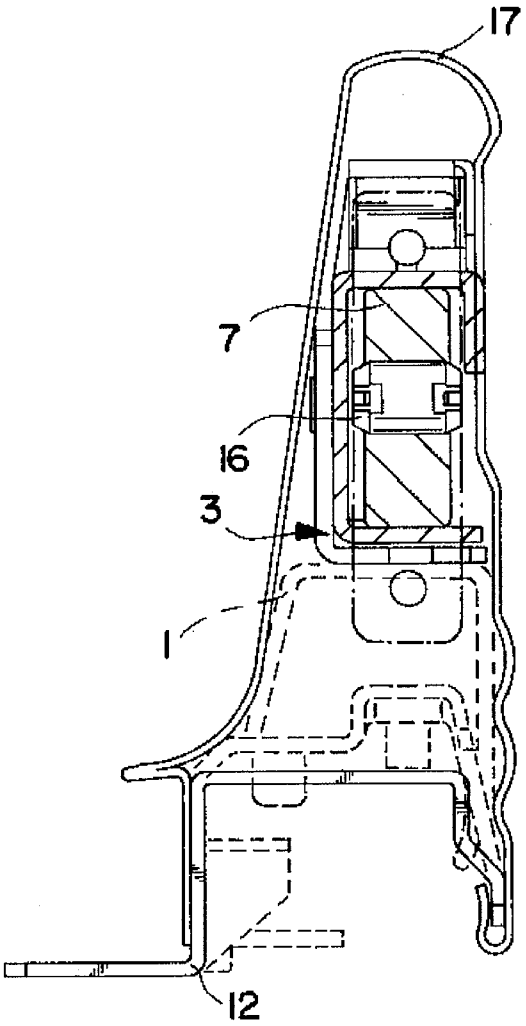
FIG. 42 is an end view, partially in section, of a drawer frame.
Figure 44:
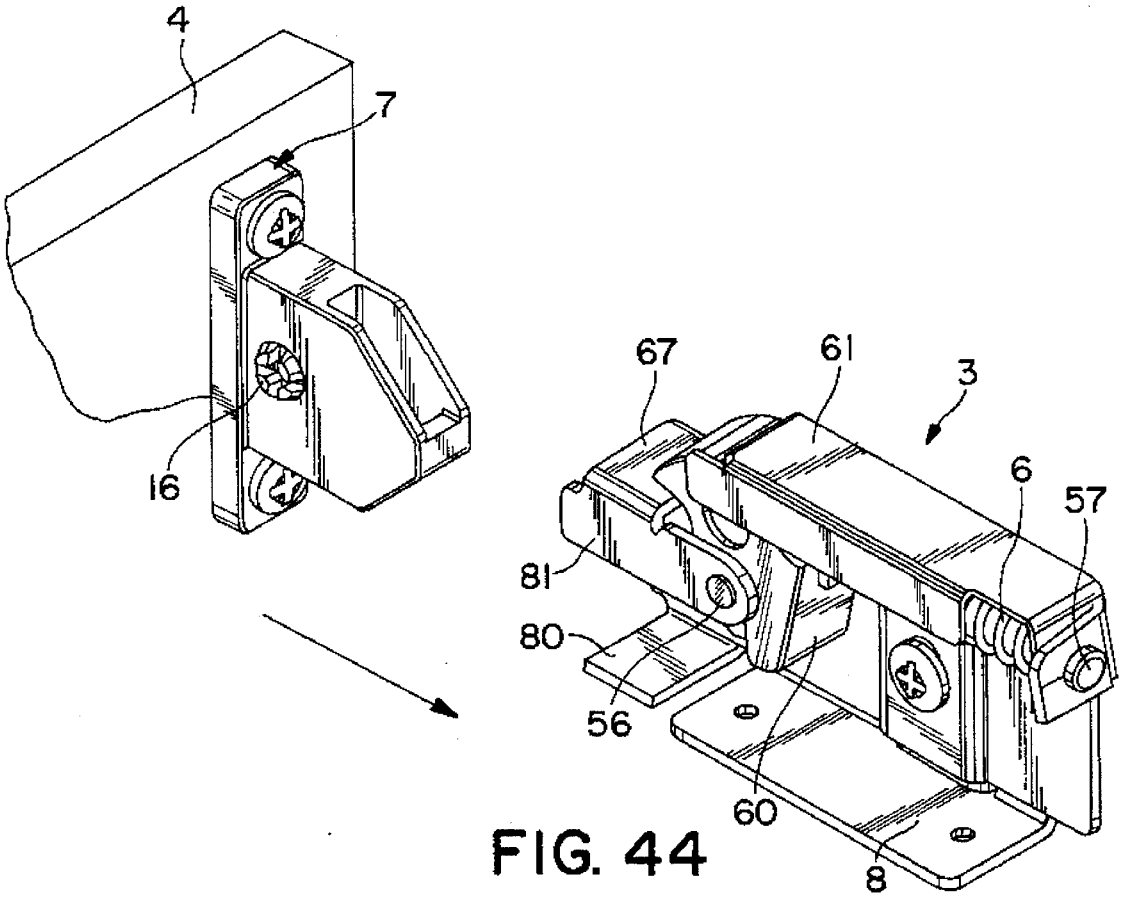
FIG. 44 is a perspective view of the apparatus before suspension of the front panel.
Figure 45:
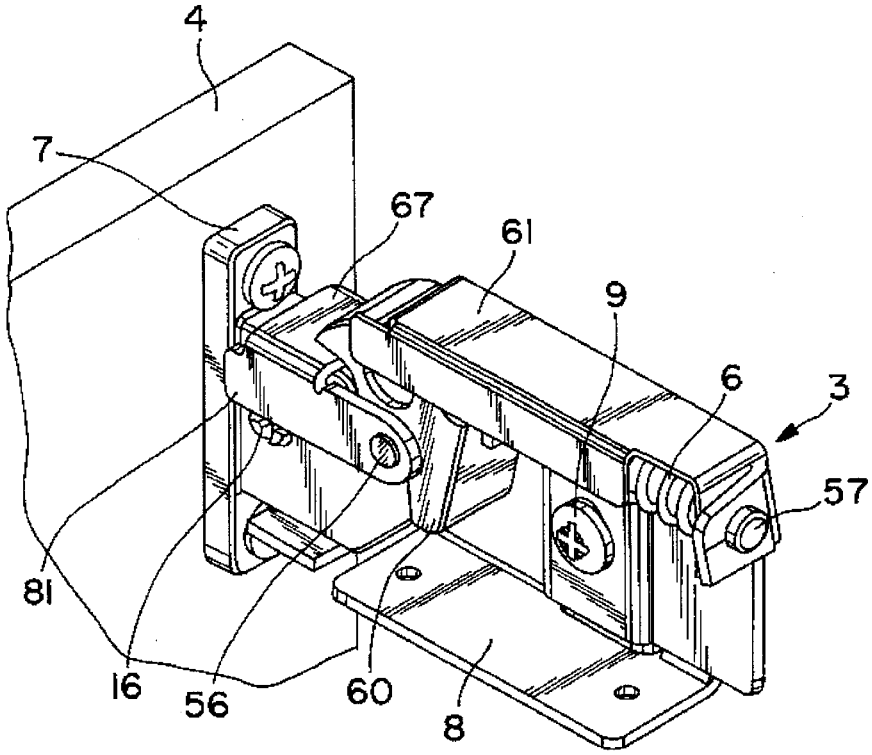
FIG. 45 is a perspective view of the apparatus with the front panel suspended.
Figure 46:
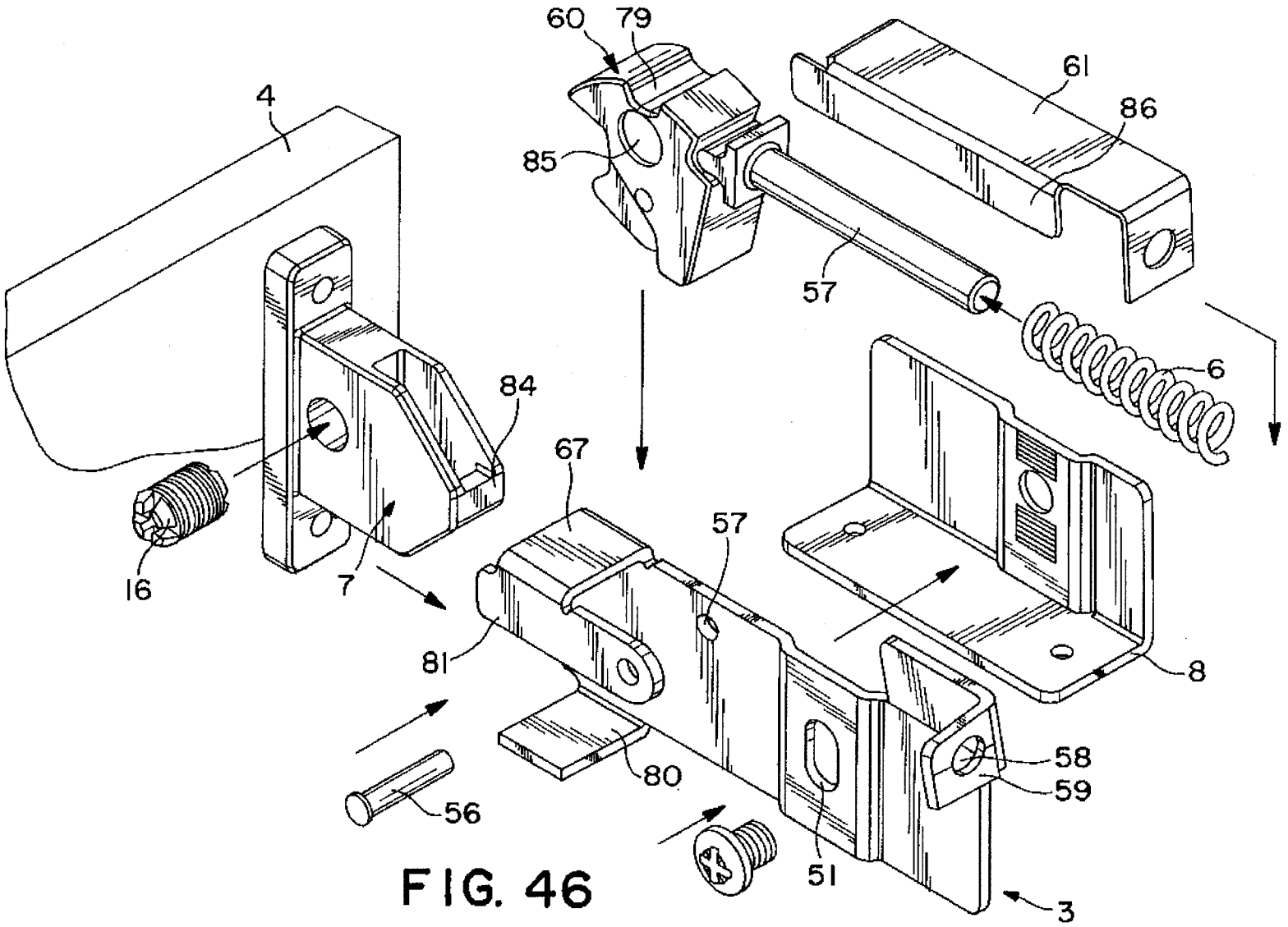
FIG. 46 is an exploded perspective view of individual parts of the apparatus according to the invention.

Before the holding part 7 is inserted into the receiving plate 3, the tilt segment 60 is in the position shown in FIG. 39, that is to say it is urged clockwise by the spring 6 and is turned far enough for lug 66 of tilt segment 60 to abut against the web 67. When the holding part 7 is inserted into the receiving plate 3, the lug 84 latches into the notch 64 and turns the tilt segment 60 counterclockwise. When the spring 6 has overcome the dead center position, the tilt segment 60 is also turned counterclockwise by the spring 6, and thus the holding part 7 is drawn into the receiving plate 3 and the front panel 4 is pushed against the drawer frames 17.

The tilt segment 60 is provided with an opening 85 which is of cylindrical construction in a front region thereof and is in the shape of a cross slot in a rear region thereof. The locking bar 61 has a lateral web 63 which reaches laterally over the tilt segment 60. If the front panel 4 is to be released from the drawer frame 17, a screwdriver 69 is introduced into the opening 85 to the cross slot. As a result, the locking bar 61 is raised since the screwdriver 69 abuts against web 86 thereof. At the same time, the stop tab 63 is raised out of the notch 79 of the tilt lever 60 and the tilt lever 60 is thus free. The tilt lever 60 can now be turned clockwise, if the cross-shaped screwdriver 69 projects into the cross slot region of the opening 85, as a result of which the holding part 7 is released.

When the front panel 4 is mounted, the stop tab 63 of the locking bar 61 and the corresponding stop face of the notch 79 of the tilt lever 60 are spaced from one another, so that if a drawer is pushed into the furniture carcass too forcefully, a shock absorber effect occurs. If the front panel 4 abuts against the side walls 11 of the furniture, the drawer frames 17 can be moved away from the front panel 4 in opposition to the force of the springs 6 by the amount permitted by the spacings between the stop tabs 63 and the stop faces of the notches 79. Then, the drawer frames 17 are pushed back against the front panel 4 by the springs 6.

We claim:

1. An apparatus for securing a front panel of a drawer to a drawer frame, said apparatus comprising:

a holding part to be connected to the front panel;

a support part to be connected to the drawer frame, said support part having an angled tab;

said holding part and said support part being capable of being coupled together in engagement;

a spring supported against said angled tab of said support part and a web of said holding part and urging said support part and said holding part relative to each other in a direction to be longitudinally of the drawer frame; and said holding part, when said holding part and said support part are coupled together and when the front panel is connected to said holding part, being movable to a limited extent relative to said support part in opposition to the urging of said spring.

2. An apparatus as claimed in claim 1, wherein said spring comprises a helical spring.

3. An apparatus as claimed in claim 1, wherein said spring comprises a pressure spring.

4. An apparatus as claimed in claim 1, wherein said holding part has a resilient bow shape including said web against which said spring is supported.

5. An apparatus as claimed in claim 1, wherein said tab is on a vertically adjustable receiving plate of said support part.

6. An apparatus as claimed in claim 5, wherein said receiving plate has extending therefrom a limiting tab abuttable against a stop face of said holding part to limit the extent of movement thereof in a direction to be outwardly of the drawer frame.

7. An apparatus as claimed in claim 1, wherein said tab projects into a lateral cutout in said holding part.

8. An apparatus as claimed in claim 7, wherein said cutout extends continuously laterally through said holding part.

9. An apparatus as claimed in claim 1, wherein said holding part has a stop for insertion of a pressing ram to exert pressure on said holding part in a direction to be toward the front panel.

10. An apparatus as claimed in claim 1, wherein said holding part includes at least one dowel to be inserted into the front panel.

11. An apparatus as claimed in claim 10, wherein said dowel is spreadable, and said holding part includes a spreading pin to be moved into and spread said spreadable dowel.

12. An apparatus as claimed in claim 11, wherein said spreading pin is connected to said holding part by a break point.

13. An apparatus as claimed in claim 11, comprising two spreadable dowels and two spreading pins.

14. An apparatus as claimed in claim 13, wherein said two spreading pins are connected by a yoke having a stop for contact by a pressing ram to move said spreading pins into respective said spreadable dowels.

15. An apparatus for securing a front panel of a drawer to a drawer frame, said apparatus comprising:

a holding part to be connected to the front panel, said holding part having at least one hook;

a support part to be connected to the drawer frame, said support part having at least one counter hook;

said hook of said holding part being suspendable over said counter hook of said support part;

a ratchet tiltably mounted about a horizontal axis on said support part, said ratchet having a lug engageable against a stop face of said hook on said holding part; and a spring engaged with said support part and operating to urge said support part in a direction to press said lug against said stop face, said holding part, when said holding part and said support part are coupled together and when the front panel is connected to said holding part, being movable to a limited extent relative to a portion of said support part in opposition to the urging of said spring.

16. An apparatus as claimed in claim 15, wherein said support part comprises a base plate to be fixed to the drawer frame and a receiving plate mounted on said base plate, said spring acting between said base plate and said receiving plate to urge said receiving plate in said direction.

17. An apparatus as claimed in claim 16, wherein said ratchet is mounted on said receiving plate.

18. An apparatus as claimed in claim 16, wherein said counter hook is on said receiving plate.

19. An apparatus as claimed in claim 15, wherein said support part has upper and lower counter hooks, said holding part has upper and lower hooks suspendable over said upper and lower counter hooks, respectively, and said stop face is on said upper hook.

20. An apparatus as claimed in claim 19, wherein said spring comprises a helical spring.

21. An apparatus as claimed in claim 19, wherein said spring comprises a pressure spring.

22. An apparatus for securing a front panel of a drawer to a drawer frame, said apparatus comprising:

a holding part to be connected to the front panel;

a support part to be connected to the drawer frame, said support part having a lower horizontal web and an upper horizontal web spaced above said lower horizontal web, said lower and upper horizontal webs defining a horizontal guide;

said holding part being insertable horizontally into said horizontal guide of said support part;

a tilt lever mounted about a horizontal axis on said support part and tiltable about said axis to a position coupling said holding part to said support part when said holding part is inserted into said horizontal guide;

a spring acting between said support part and said tilt lever to urge said tilt lever to tilt to said position; and said holding part, when said holding part and said support are coupled together and when the front panel is connected to said holding part, being movable to a limited extent relative to said support part in opposition to the urging of said spring.

23. An apparatus as claimed in claim 22, wherein said spring comprises a helical spring.

24. An apparatus as claimed in claim 22, wherein said spring comprises a pressure spring.

25. An apparatus as claimed in claim 22, wherein said upper and lower webs are part of a housing integral with said support part and having therein said horizontal guide.

26. An apparatus as claimed in claim 25, wherein said housing has therein a slot, and said tilt lever is mounted on said housing and projects through said slot.

27. An apparatus as claimed in claim 22, wherein said tilt lever and said spring pass a dead center position upon insertion of said holding part into said horizontal guide.

28. An apparatus as claimed in claim 22, further comprising a locking bar having a stop tab confronting a counter stop of said tilt lever, said tilt lever being movable in opposition to said urging of said spring into abutment with said stop tab.

29. An apparatus as claimed in claim 28, wherein said locking bar is mounted about said horizontal axis and is in the form of a two arm lever including a first arm held in a slot in said support part.

30. An apparatus as claimed in claim 28, wherein said locking bar is resilient in a direction transverse to a direction of tilting of said tilt lever.

31. An apparatus as claimed in claim 28, wherein said tilt lever has a notch into which projects said stop tab of said locking bar.

32. An apparatus as claimed in claim 28, wherein said tilt lever has upper and lower notches, said holding part includes a hook latching into said lower notch, and said stop tab of said locking bar latches into said upper notch.

33. An apparatus as claimed in claim 28, wherein said locking bar extends horizontally and bears on said tilt lever and has a lateral web extending over said tilt lever.

34. An apparatus as claimed in claim 22, wherein said upper and lower horizontal webs have at front ends thereof stops that extend vertically upwardly and vertically downwardly, respectively.

35. An apparatus as claimed in claim 22, wherein said tilt lever has therein a cross slot to receive therein a screwdriver.

36. An apparatus as claimed in claim 22, further comprising a rod articulated to said tilt lever, said spring being supported on said rod.

37. An apparatus as claimed in claim 36, wherein said rod has a free end freely supported by said support part.

38. An apparatus as claimed in claim 22, wherein said holding part has a curved support surface to be engaged by said tilt lever.

39. An apparatus as claimed in claim 38, wherein said curved support surface is arranged in a housing of said holding part.

40. An apparatus as claimed in claim 38, wherein said tilt lever has a step-shaped notch into which latches an edge of said curved support surface.

* * * * *